US009389562B1

(12) United States Patent
Sasaki et al.

(10) Patent No.: US 9,389,562 B1
(45) Date of Patent: Jul. 12, 2016

(54) IMAGE FORMING APPARATUS AND IMAGE FORMING METHOD

(71) Applicant: KONICA MINOLTA, INC., Chiyoda-ku, Tokyo (JP)

(72) Inventors: Kunitomo Sasaki, Takatsuki (JP); Kazuko Fukumoto, Ibaraki (JP); Yuji Kamoda, Ibaraki (JP); Yasuo Shirodai, Hachioji (JP); Yuya Sato, Fuchu (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/972,430

(22) Filed: Dec. 17, 2015

(30) Foreign Application Priority Data

Dec. 18, 2014 (JE) ..... 2014-256111

(51) Int. Cl.
*G03G 21/00* (2006.01)
*G03G 15/00* (2006.01)

(52) U.S. Cl.
CPC ..... *G03G 15/50* (2013.01)

(58) Field of Classification Search
CPC ..... G03G 15/50; G03G 21/00
USPC ..... 399/346, 349
See application file for complete search history.

(56) References Cited

U.S. PATENT DOCUMENTS 7,929,875 B2 * 4/2011 Nishida ..... G03G 15/5037 399/346
2006/0210334 A1 * 9/2006 Tokumasu ..... G03G 21/0005 399/346
2011/0008088 A1 * 1/2011 Nakai ..... G03G 21/0094 399/346
2011/0129270 A1 * 6/2011 Seo ..... G03G 21/0011 399/346
2011/0206431 A1 * 8/2011 Tawada ..... G03G 21/0094 399/346
2011/0206432 A1 * 8/2011 Ninomiya ..... G03G 21/0094 399/346

FOREIGN PATENT DOCUMENTS

JP 2002-006689 A 1/2002
JP 2006-259031 A 9/2006
JP 2007-240768 A 9/2007
JP 2013-101169 A 5/2013
JP 2014-142472 A 8/2014

* cited by examiner

*Primary Examiner* — Susan Lee
(74) *Attorney, Agent, or Firm* — Buchanan Ingersoll & Rooney PC

(57) ABSTRACT

An image forming apparatus includes: an image carrier; a development unit configured to develop, as a toner image, an electrostatic latent image formed on the image carrier; a transfer unit configured to transfer the toner image to a medium to which a toner image is to be transferred; a cleaning unit configured to recover toner remaining on the image carrier after transferring the toner image; a lubricant supply unit configured to supply lubricant on the image carrier; a charge unit disposed between the development unit and the cleaning unit, along a surface of the image carrier; and a control unit configured to perform a first mode and a second mode, the first mode configured to form the toner image, the second mode configured to allow the charge unit to increase the amount of charge on toner reaching the cleaning unit relative to that in the first mode.

15 Claims, 10 Drawing Sheets

IMAGE FORMING APPARATUS AND IMAGE FORMING METHOD

The entire disclosure of Japanese Patent Application No. 2014-256111 filed on Dec. 18, 2014 including description, claims, drawings, and abstract are incorporated herein by reference in its entirety.

BACKGROUND OF THE INVENTION

1. Field of the Invention

The present invention relates to an image forming apparatus having a function of supplying lubricant on an image carrier, and an image forming method in an image forming apparatus.

2. Description of the Related Art

Electrophotographic image forming apparatuses, such as multifunctional peripherals, copying machines, or printers, have been widely used conventionally. Such an electrophotographic image forming apparatus generally includes an image carrier having a surface on which a toner image is formed while being rotationally driven, a transfer device transferring the formed toner image to a transfer body or a medium, and a cleaning member recovering remaining toner on the surface of the image carrier after the toner image is transferred, and cleaning the surface of the image carrier.

As the image carrier, a photoreceptor is used. A cycle is repeatedly performed on the photoreceptor. The cycle includes a charging step of uniformly charging the surface of the photoreceptor, an exposure step of exposing the surface of the photoreceptor according to a specified image pattern and forming an electrostatic latent image, and a development step of supplying toner to the image carrier and developing the electrostatic latent image.

Further, in order to reduce a friction force generated between the cleaning member and the image carrier, a lubricant supply mechanism is generally provided which supplies lubricant on the image carrier. As the lubricant, a metal soap such as a metal stearate is generally used. The lubricant supply mechanism is known which is provided with an application mechanism including a brush on the upstream or downstream side of the cleaning member, supplies lubricant at a developing unit, adding the lubricant to toner, or has a combination thereof. The lubricant supply mechanism is provided to apply lubricant to the surface of the image carrier, and thus, a frictional coefficient is reduced with respect to toner on the surface of the image carrier. Reduction of the frictional coefficient inhibits transfer failure upon transfer of the toner image formed on the surface of the image carrier to a transfer material or the like, and the quality of the toner image can be increased. Further, a frictional coefficient between the image carrier and a member (e.g., cleaning blade or the like) making pressure-contact with the image carrier is also reduced, and thus, abrasion (scraping) on the surface of the image carrier is effectively inhibited, and the life of the image carrier can be also extended For example, in JP 2002-006689 A, an image forming apparatus is disclosed. The image forming apparatus supplies lubricant to an image carrier forming a toner image to extend the life thereof and increase image quality. More specifically, an image forming apparatus disclosed in JP 2002-006689 A temporarily recovers lubricant on a photoreceptor, raises a frictional coefficient, and then supplies lubricant, in order to remove a discharge product on a photoreceptor.

Further, in JP 2014-142472 A, an image forming apparatus is disclosed which can reduce a difference in level of a photoreceptor caused by abrasion. More specifically, the image forming apparatus disclosed in JP 2014-142472 A obtains an amount of images integrated by integration of gradation values of image information corresponding to a plurality of blocks. The blocks are obtained by dividing an image formed on a photoreceptor in a rotational axis direction (longitudinal direction) of the photoreceptor. Then, the image forming apparatus specifies a position of the photoreceptor in the rotational axis direction, and predicts the generation of a difference in level on the photoreceptor caused by abrasion. Next, the image forming apparatus forms a ZnSt supply image at the predicted position to supply ZnSt particles, and prevents the surface of the photoreceptor from being further abraded at this position.

Although lubricant is not supplied, in JP 2007-240768 A, an image forming apparatus is disclosed which supplies an appropriate amount of toner only to a position having a reduced amount of toner on the image carrier, and shows the maximum performance of the cleaning blade.

In contrast, a lubricant layer including lubricant deteriorates due to a discharge product generated in the charging step or the like, and the lubricant layer itself also deteriorates due to change in quality of the lubricant itself. Such deterioration may reduce the resistance of the lubricant layer and generate a blurred image, or lose the lubricity of lubricant (effect of reducing a friction force) and generate abnormal abrasion of the cleaning blade.

For example, in JP 2006-259031 A, an image forming apparatus is disclosed which is provided with a lubricant removing mode on an image bearing member, deteriorated due to discharge from a charging device, and can prevent deterioration in quality of images or generation of an abnormal image. More specifically, the image forming apparatus disclosed in JP 2006-259031 A is provided with a lubricant removing device and a lubricant supplying device on a photoreceptor, and uses toner as the removing device.

In terms of not lubricant but the removal of foreign matter such as paper dust, a configuration is disclosed in JP 2013-101169 A. The configuration removes the foreign matter such as paper dust accumulated in an abutment portion between a cleaning blade and an intermediate transfer belt without reducing productivity, and secures slidability of the cleaning blade to the intermediate transfer belt.

However, in the above-mentioned related art, the deteriorated lubricant cannot be fully removed, and the blurred image or the abnormal abrasion of the cleaning blade may occur. This phenomenon is considered to be caused by deterioration of the lubricant layer not separated by toner supplied during normal image formation and rigidly stuck on the image carrier.

SUMMARY OF THE INVENTION

Thus, an object of the present invention is to provide a configuration and a method which effectively and strongly remove lubricant.

To achieve the abovementioned object, according to an aspect, an image forming apparatus reflecting one aspect of the present invention comprises: an image carrier; a development unit configured to develop, as a toner image, an electrostatic latent image formed on the image carrier; a transfer unit configured to transfer the toner image to a medium to which a toner image is to be transferred; a cleaning unit configured to recover toner remaining on the image carrier after transferring the toner image; a lubricant supply unit configured to supply lubricant on the image carrier; a charge unit disposed between the development unit and the cleaning unit, along a surface of the image carrier; and a control unit, the control unit being configured to perform a first mode and a second mode, the first mode configured to form the toner image for the main purpose of transferring the toner image to the medium to which a toner image is to be transferred, the second mode configured to allow the charge unit to increase the amount of charge on toner reaching the cleaning unit, relative to that in the first mode, for the main purpose of recovering lubricant on the image carrier.

Preferably, the control unit controls the charge unit to have an amount of charge on toner reaching the cleaning unit in the second mode of not more than 90 μC/g, and being 1.5 times larger than the amount of charge on toner reaching the cleaning unit in the first mode, in absolute value.

Preferably, the control unit controls the lubricant supply unit to restrict supply of lubricant in the second mode.

Preferably, the control unit controls the transfer condition in the transfer unit to have an amount of toner reaching the cleaning unit in the second mode, being larger than the amount of toner reaching the cleaning unit in the first mode.

Preferably, the development unit functions as the lubricant supply unit.

Preferably, the control unit controls the lubricant supply unit to form a layer of lubricant on the image carrier, following recovery of lubricant on the image carrier, in the second mode.

Preferably, the control unit performs processing according to the second mode, when a predetermined start condition is satisfied.

Further preferably, the start condition includes arrival of the number of times of forming the toner image to a predetermined value, in the first mode.

Further preferably, the control unit uses an image pattern having toner over a rotational axis direction of the image carrier, in the second mode.

Alternatively, preferably, the start condition includes continuous formation of the same image pattern a predetermined number of times, in the first mode.

Further preferably, the control unit uses a negative pattern obtained by inverting the same image pattern in color, in the second mode.

Alternatively, preferably, the start condition includes excess of a difference in an integrated print density value over a predetermined value between any two areas, the integrated print density value obtained in the first mode being calculated for each of a plurality of areas set along the rotational axis direction of the image carrier.

Further preferably, the control unit adjusts an amount of electrical charge applied by the charge unit along the rotational axis direction of the image carrier, according to each integrated print density value of the plurality of areas.

Preferably, lubricant is a metal stearate.

To achieve the abovementioned object, according to an aspect, an image forming method in an image forming apparatus including an image carrier, a development unit, a transfer unit, a cleaning unit, and a lubricant supply unit, the development unit configured to develop, as a toner image, an electrostatic latent image formed on the image carrier, the transfer unit configured to transfer the toner image to a medium to which a toner image is to be transferred, the cleaning unit configured to recover toner remaining on the image carrier after transferring the toner image, the lubricant supply unit configured to supply lubricant on the image carrier, the image forming method reflecting one aspect of the present invention comprises: forming the toner image for the main purpose of transferring the toner image to the medium to which a toner image is to be transferred; and increasing the amount of charge on toner reaching the cleaning unit, relative to that for the main purpose of transferring the toner image to the medium to which a toner image is to be transferred, by a charge unit, for the main purpose of recovering lubricant on the image carrier, the charge unit being disposed along a surface of the image carrier between the development unit and the cleaning unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
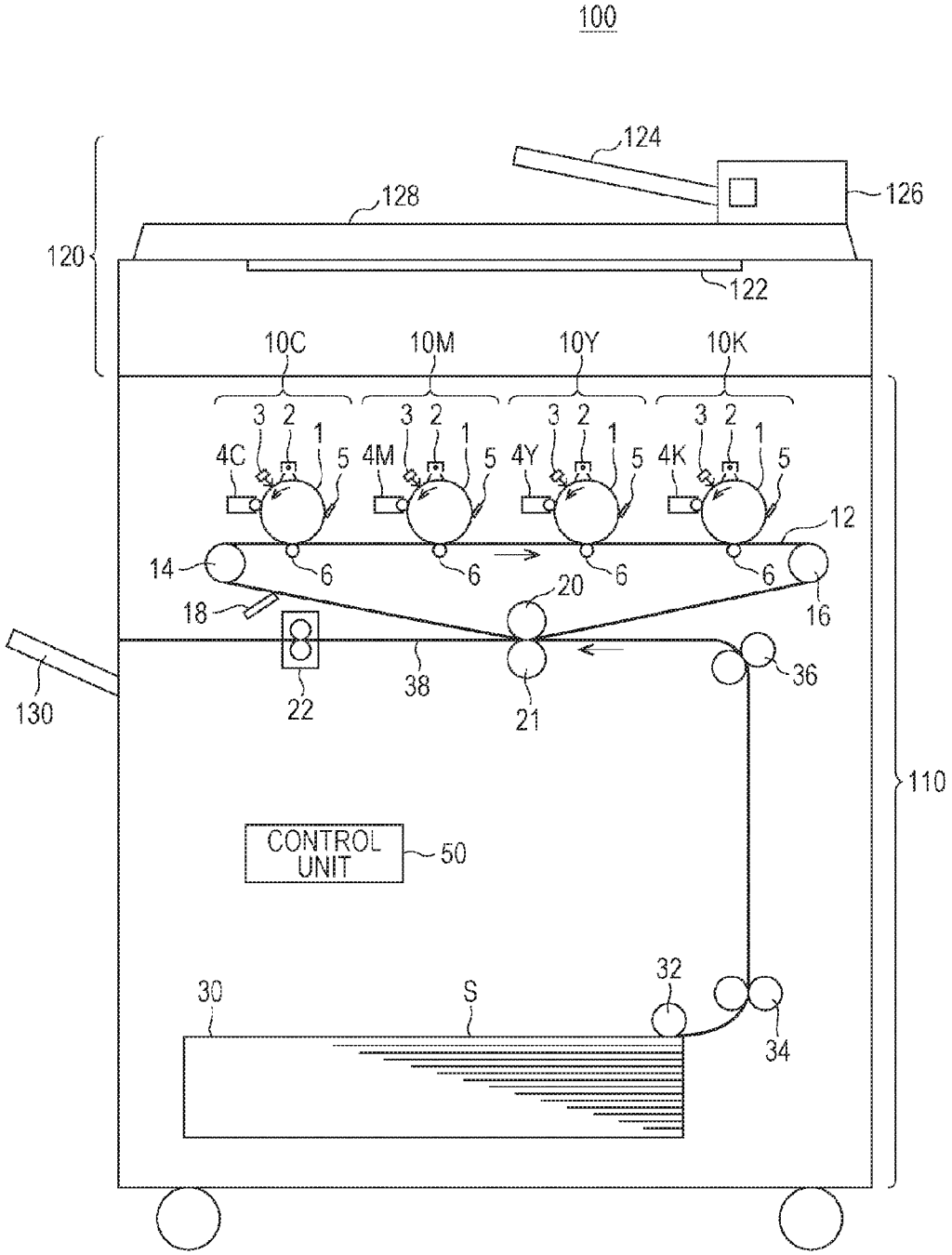
FIG. 1 is a schematic configuration diagram illustrating a cross-sectional configuration of an image forming apparatus according to the present embodiment.

Hereinafter, an embodiment of the present invention will be described with reference to the drawings. However, the scope of the invention is not limited to the illustrated examples. Note that the same or corresponding parts in the drawings are denoted by the same reference signs, and description thereof will not be repeated.

A. Configuration of Image Forming Apparatus

First, a configuration of an image forming apparatus 100 according to the present embodiment will be described. The image forming apparatuses 100 described below typically includes color image forming apparatuses implemented as multi-functional peripherals (MFP). However, a mechanism and a method which remove deteriorated lubricant according to the present embodiment can also be applied to monochrome image forming apparatuses. Although a tandem mechanism will be described as an example of a color image-forming mechanism, the mechanism can also be applied to a cycle mechanism (typically, four-cycle mechanism).

FIG. 1 is a schematic configuration diagram illustrating a cross-sectional configuration of the image forming apparatus 100 according to the present embodiment. With reference to FIG. 1, the image forming apparatus 100 includes a print engine 110, a document reading unit 120, and an output tray 130.

The print engine 110 performs an electrophotographic image forming process. A configuration illustrated in FIG. 1 enables full-color printout. A printout medium is ejected to the output tray 130. A detailed configuration of the print engine 110 will be described later.

The document reading unit 120 reads a document, and outputs a result of the reading as an image to be input to the print engine 110. More specifically, the document reading unit 120 includes an image scanner 122, a document input tray 124, an automatic document feeder 126, and a document output tray 128.

The image scanner 122 scans the document put on a platen glass. The image scanner 122 includes, as main components, a light source emitting light to the document, an image sensor obtaining an image generate by the light emitted from the light source and reflected from the document, an analog-to-digital (AD) converter outputting an image signal from the image sensor, and an imaging optical system disposed preceding the image sensor.

The automatic document feeder 126 continuously scan the documents put on the document input tray 124. The documents put on the document input tray 124 are fed out one by one by a feed roller not illustrated, and sequentially scanned by the image sensor disposed in the image scanner 122 or the automatic document feeder 126. The scanned documents are ejected to the document output tray 128.

The print engine 110 includes imaging units 10C, 10M, 10Y, and 10K (hereinafter, may be collectively referred to as "imaging unit 10") generating the toner images of cyan (C), magenta (M), yellow (Y), and black (K) colors, respectively.

As an example, the image forming apparatus 100 according to the present embodiment employs a configuration for transferring toner images generated by the imaging unit 10 to the medium S through an intermediate transfer body. The image forming apparatus 100 includes, as the intermediate transfer body, an intermediate transfer belt 12 stretched around the intermediate transfer body-driving rollers 14 and 16. The intermediate transfer belt 12 is turned in a predetermined direction by rotational driving of the intermediate transfer body-driving rollers 14 and 16. As the intermediate transfer body, an intermediate transfer roller may be employed instead of the intermediate transfer belt illustrated in FIG. 1. Although the configuration for transferring the toner images to the medium S as a member to be transferred, after the toner images are temporarily transferred to the intermediate transfer body is illustrated as an example in FIG. 1, the configuration may be configured to directly transfer the toner images on the photoreceptor to the medium S.

The imaging units 10C, 10M, 10Y, and 10K are disposed in this order along the intermediate transfer belt 12 stretched in the print engine 110 and rotationally driven. The imaging unit 10 includes a photoreceptor 1, a charging unit 2, an exposure unit 3, a developing unit 4 (denoted by 4C, 4M, 4Y, and 4K corresponding to colors of the toner images generated by the corresponding imaging unit 10), an image carrier-cleaning member 5, and an intermediate transfer body contact roller 6, corresponding to colors.

The photoreceptor 1 is an image carrier carrying a toner image, and employs a photoreceptor roller having a surface on which a photosensitive layer is formed. The photoreceptor 1 is disposed to have a surface on which a toner image is to be formed, and is rotated in a direction corresponding to a rotational direction of the intermediate transfer belt 12. As the image carrier, a photoreceptor belt may be employed instead of the photoreceptor roller.

The electrostatic latent image is formed on the photoreceptor 1 by the exposure unit 3, the electrostatic latent image is developed by the developing unit 4, and the toner image is generated. That is, the charging unit 2, the exposure unit 3, and the developing unit 4 form the electrostatic latent image and the toner image on the photoreceptor 1.

The charging unit 2 uniformly charges the surface of the photoreceptor 1. The exposure unit 3 uses laser writing to expose the surface of the photoreceptor 1 according to a specified image pattern, and the electrostatic latent image is formed on the surface of the photoreceptor 1. Typically, the exposure unit 3 includes a laser diode generating laser light, and a polygon mirror reflecting the laser light along a main scanning direction to expose the surface of the photoreceptor 1.

The developing unit 4 develops, as the toner image, the electrostatic latent image formed on the photoreceptor 1 being the image carrier. The developing unit 4 typically develops the electrostatic latent image using a two-component developer including toner and carrier. Note that the development unit may use a single-component developer (toner).

The toner image formed on the surface of the photoreceptor 1 is transferred to the intermediate transfer belt 12 by the intermediate transfer body contact roller 6. The intermediate transfer body contact roller 6 transfers the toner image developed on the photoreceptor 1 to the intermediate transfer belt 12 as a medium to which a toner image is to be transferred. The photoreceptor 1 and the intermediate transfer belt 12 are brought into contact with each other at a portion provided with the intermediate transfer body contact roller 6. The portion is configured so that a predetermined transfer bias is applied, and the toner image on the photoreceptor 1 is transferred to the intermediate transfer belt 12 by the transfer bias.

The toner images are sequentially transferred to the intermediate transfer belt 12 from the photoreceptors 1, respectively, and the four color toner images are superposed. The superposed toner images are transferred to the medium S from the intermediate transfer belt 12 by the transfer rollers 20 and 21. As a configuration relating to transfer of the medium S, the print engine 110 includes a paper feed unit 30 holding the mediums S, a feed roller 32, conveyance rollers 34 and 36, and a fusing unit 22. The feed roller 32 sequentially feeds the mediums S from the paper feed unit 30, and the mediums S are conveyed by the conveyance rollers 34 and 36. Feeding and conveyance timing of the medium S and a position on the intermediate transfer belt 12 where the toner images are superposed are synchronized with each other and the toner image can be transferred to an appropriate position of the medium S. The medium S to which the toner image has been transferred is conveyed to the fusing unit 22 along a conveyance path 38, and fusing of the toner image is performed at the fusing unit 22. Then, the medium S on which the toner image has been fused is ejected to the output tray 130.

The print engine 110 includes a control unit 50 performing overall control of the image forming apparatus 100. The control unit 50 includes, as main components, a processor such as a central processing unit (CPU), a volatile memory such as a dynamic random access memory (DRAM), a non-volatile memory such as a hard disk drive (HDD), and various interfaces. In the print engine 110, the processor typically executes various programs stored in the non-volatile memory to perform processing relating to image formation in the image forming apparatus 100.

Although the control unit 50 is achieved by execution of the programs by the processor, all or part of the processing may be achieved using dedicated hardware. Further, when the processor executes a program, the program may be installed on the non-volatile memory through various recording mediums or may be downloaded from a server apparatus, not illustrated, or the like through a communication line.

B. Basic Image Forming Process in Image Forming Apparatus

Next, a basic image forming process performed in the image forming apparatus 100 illustrated in FIG. 1 will be described following a performance sequence thereof.

In the imaging unit 10, after the surface of the photoreceptor 1 is uniformly charged by the charging unit 2, scanning exposure with a laser is performed on the photoreceptor 1 by the exposure unit 3, the laser being controlled to emit light according to information about the image to be input. Therefore, the electrostatic latent image is formed on the surface of the photoreceptor 1. Image information is used for a step (optical writing step) of performing the scanning exposure by the exposure unit 3 during rotation of the photoreceptor 1 and forming the electrostatic latent image. The image information is single color image information which is obtained by disintegrating a specified image to be input (full-color image) into cyan, magenta, yellow, and black color information. The control unit 50 controls light emission and scanning of the laser, according to the single color image information.

The electrostatic latent images on the photoreceptors 1 formed according to the single color image information are developed on the photoreceptors 1 by the developing units 4C, 4M, 4Y, and 4K, with single color developers including corresponding cyan, magenta, yellow, and black toner, respectively, and the toner images are formed according to the image information, respectively. That is, on each photoreceptor 1, a single color toner image of corresponding color is formed. The single color toner images are sequentially transferred and superposed on the intermediate transfer belt 12, by the function of the predetermined transfer bias, in synchronization with the corresponding photoreceptors 1. The single color toner images superposed on the intermediate transfer belt 12 are collectively transferred by the transfer rollers 20 and 21 to the medium S transferred from the paper feed unit 30. At this time, the predetermined transfer bias is applied between the intermediate transfer belt 12 and the medium S. After transfer of the toner images, the toner images on the medium S are fused by the fusing unit 22, the full-color image is completed, and the medium S on which the full-color image formed is ejected to the output tray 130.

As a final step of the image forming process in the photoreceptor 1, remaining toner after transfer on the photoreceptor 1 (toner remaining after transfer of the toner image formed on the surface of the photoreceptor 1 to the intermediate transfer belt 12) is cleaned. In order to perform cleaning of the surface of the photoreceptor 1, the image carrier-cleaning member 5 is provided which usually abuts on the photoreceptor 1. The image carrier-cleaning member 5 is a cleaning unit recovering toner remaining on the photoreceptor 1 as the image carrier, after transfer of the toner image, and abuts on the photoreceptor 1 to scrape the remaining toner after transfer, from the surface of the photoreceptor 1.

The remaining toner after transfer on the intermediate transfer belt 12 is also cleaned similarly. In order to perform cleaning of a surface of the intermediate transfer belt 12, an intermediate transfer body cleaning member 18 is provided which abuts on the intermediate transfer belt 12. The intermediate transfer body cleaning member 18 is a cleaning unit recovering toner remaining on the intermediate transfer belt 12 as the image carrier, after transfer of the toner images.

C. Lubricant Supply Mechanism

Figure 2:
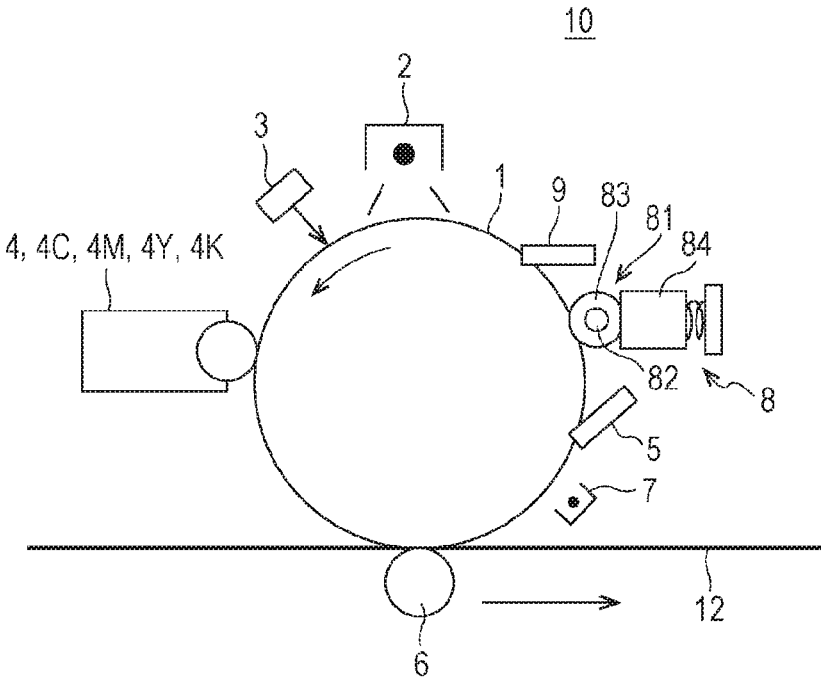
FIG. 2 is a schematic diagram illustrating an exemplary configuration of an imaging unit according to the present embodiment.
Figure 3:
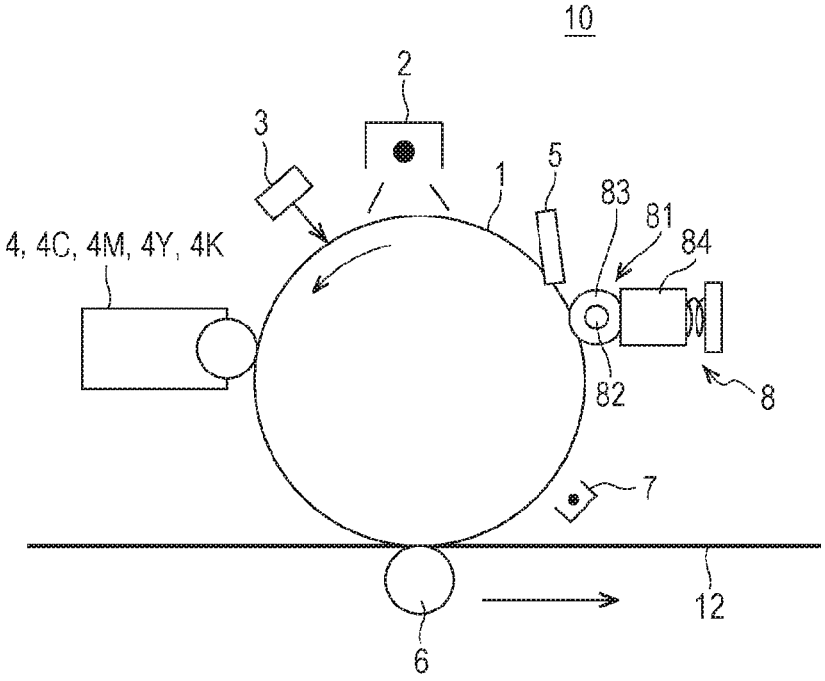
FIG. 3 is a schematic diagram illustrating another exemplary configuration of an imaging unit according to the present embodiment.
Figure 4:
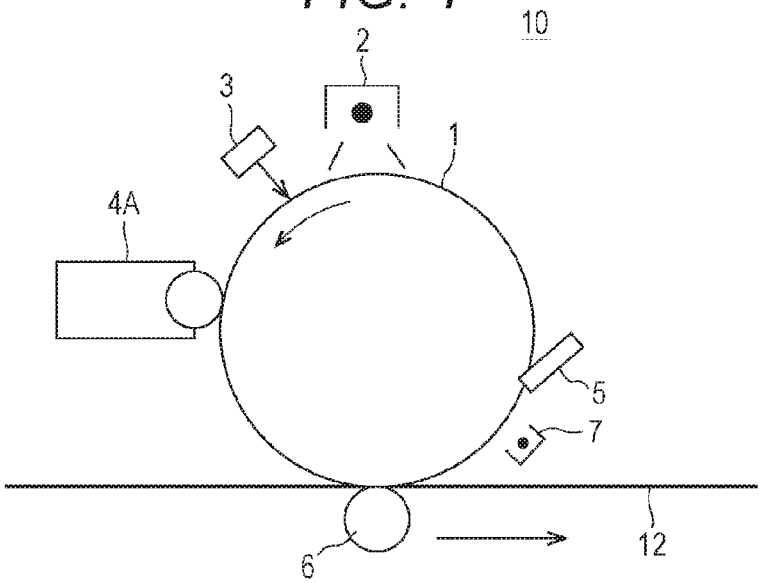
FIG. 4 is a schematic diagram illustrating still another exemplary configuration of an imaging unit according to the present embodiment.

Next, the lubricant supply mechanism supplying lubricant on the photoreceptor 1 as the image carrier will be described. An exemplary configuration of peripheral members of the image carrier is illustrated in FIGS. 2 to 4. FIG. 2 is a schematic diagram illustrating an exemplary configuration of the imaging unit 10 according to the present embodiment. FIG. 3 is a schematic diagram illustrating another exemplary configuration of the imaging unit 10 according to the present embodiment. FIG. 4 is a schematic diagram illustrating still another exemplary configuration of the imaging unit 10 according to the present embodiment.

In the imaging unit 10 illustrated in FIG. 2, a lubricant supply unit 8 and a smoothing member 9 are disposed as the lubricant supply mechanism, around the photoreceptor 1, in addition to the charging unit 2, the exposure unit 3, the developing unit 4, and the image carrier-cleaning member 5.

The lubricant supply unit 8 includes an application brush 81 abutting on the photoreceptor 1 and a solid lubricant 84. The application brush 81 is rotated relative to the photoreceptor 1, scrapes the solid lubricant 84, and applies the solid lubricant 84 to the photoreceptor 1. The smoothing member 9 smooths lubricant supplied from the lubricant supply unit 8 to promote formation of the lubricant layer on the surface of the photoreceptor 1.

The application brush 81 includes a shaft member 82 extending in a width direction of the photoreceptor 1 (depth direction in the drawings), and a plurality of bristles 83 disposed on the outer peripheral surface of the shaft member 82. As an example, the application brush 81 is configured by fixedly wrapping a backing fabric into which the plurality of bristles are embedded, around the shaft member 82. The backing fabric has a length adjusted to bring the bristles into contact with the whole area at least in the width direction of the photoreceptor 1. The shaft member 82 is mechanically connected to a motor not illustrated to be driven independently of the photoreceptor 1. Further, the shaft member 82 can be driven by mechanical connection to a drive unit of another member, without a dedicated motor.

When the application brush 81 is rotated, the solid lubricant 84 is scraped by the bristles of the application brush 81, and the solid lubricant 84 sticking to the bristles of the application brush 81 is applied to the surface of the photoreceptor 1. That is, rotational drive of the application brush 81 causes the lubricant supply unit 8 to function as the lubricant supply mechanism.

Although an exemplary configuration is illustrated in FIG. 2, in which the lubricant supply unit 8 is disposed downstream of the image carrier-cleaning member 5 (cleaning blade), the lubricant supply unit 8 may be disposed upstream of the image carrier-cleaning member 5. In the exemplary configuration illustrated in FIG. 3, since the lubricant supply unit 8 is disposed downstream of the image carrier-cleaning member 5, the image carrier-cleaning member 5 has a function of smoothing lubricant supplied by the lubricant supply unit 8, in addition to a function of cleaning the remaining toner after transfer on the photoreceptor 1.

Alternatively, the developing unit 4 may have a lubricant supply function. In the exemplary configuration illustrated in FIG. 4, lubricant is added to toner supplied by the developing unit 4, and thus the lubricant is supplied to the photoreceptor 1. That is, in the exemplary configuration illustrated in FIG. 4, the developing unit 4 has a function as the lubricant supply unit.

Further, the exemplary configurations illustrated in FIGS. 2 to 4 may be appropriately combined.

Operation and function of the auxiliary charging unit 7 illustrated in FIGS. 2 to 4 will be described later.

D. Lubricant

In the image forming apparatus 100 according to the present embodiment, the solid lubricant includes a metal soap such as metal stearate. In particular, the solid lubricant includes zinc stearate selected from metal stearates.

An example of the solid lubricant includes dry solid hydrophobic lubricant. As the dry solid hydrophobic lubricant, a metal salt of a fatty acid of relatively higher order (metal soap) can be employed, typically including metal stearate such as zinc stearate, barium stearate, lead stearate, ferric stearate, nickel stearate, cobalt stearate, copper stearate, strontium stearate, calcium stearate, cadmium stearate, magnesium stearate, zinc oleate, manganese oleate, ferric oleate, cobalt oleate, lead oleate, magnesium oleate, copper oleate, zinc palmitate, cobalt palmitate, copper palmitate, magnesium palmitate, aluminum palmitate, calcium palmitate, lead caprylate, lead caproate, lead linolenate, cobalt linolenate, calcium linolenate, and cadmium linolenate. A metal stearate having a bond between a stearic acid and a metal is particularly preferably selected from among them. Note that natural wax such as carnauba wax may be used.

E. Summary of Problems and Solutions

Lubricant supplied by the lubricant supply mechanism and the lubricant layer (lubricant film) including lubricant are deteriorated due to a discharge product generated in the charging step or the like, and the lubricant itself also deteriorates due to change in quality of itself. When such deterioration is caused, blurred image may occur due to deterioration in resistance of the lubricant layer, or abnormal abrasion of the image carrier-cleaning member 5 (cleaning blade) may occur due to loss of lubricity of lubricant (effect of reducing friction force). Thus, a system employing the lubricant supply mechanism requires a configuration appropriately refreshing lubricant, that is, a configuration removing old lubricant on the photoreceptor 1 and applying new lubricant to the photoreceptor 1 again.

However, in any related art, the deteriorated lubricant cannot be fully removed, and the blurred image or the abnormal abrasion of the cleaning blade may occur. This phenomenon is considered to be caused by deterioration of the lubricant layer not separated by toner supplied during normal image formation and firmly stuck on the surface of the photoreceptor. Thus, a configuration and a method which effectively and strongly remove lubricant have been desired.

As a result of an extensive study, the present applicants have found that in the lubricant refreshing step, the amount of charge on toner supplied to the image carrier-cleaning member 5 (cleaning blade) is effectively increased to remove lubricant on the surface of the photoreceptor 1. Use of this function not only effectively removes lubricant on the surface of the photoreceptor 1, but also removes the deteriorated lubricant rigidly stuck and not removed during normal image formation.

Further, lubricant deterioration notably occurs particularly at a non-image portion (white portion without toner applied during image formation) during normal image formation. That is because during normal image formation, toner reaching the image carrier-cleaning member 5 (cleaning blade) has a charge, and lubricant can be removed at an image portion (black portion with toner applied during image formation), but the toner is not supplied to the image carrier-cleaning member 5 at the non-image portion, and the lubricant is unlikely removed. Therefore, for example, when the same image pattern is successively printed, lubricant deterioration may notably occur particularly at an area corresponding to the non-image portion.

In consideration of a phenomenon as described above, the image forming apparatus according to the present embodiment described below provides a function of removing the deteriorated lubricant to prevent failure caused by the deteriorated lubricant (lubricant removal function). Typically, in a lubricant removal operation, toner is supplied to the image carrier-cleaning member 5 each time an image is printed on a predetermined number of sheets, and the amount of charge on toner reaching the image carrier-cleaning member 5 is increased relative to the amount of charge on toner supplied during normal image formation. Further, based on new knowledge of the present inventors as described above, lubricant is also removed effectively, when lubricant deterioration selectively occurs according to the image pattern.

F. Principle Experiment and Mechanism for Lubricant Removal

The new knowledge of the present inventors which is employed by the image forming apparatus 100 according to the present embodiment will be described below in detail.

First, the contents and results of the principle experiment performed for verification of a main effect of the new knowledge of the present inventors will be described. Then, a mechanism for effectively removing lubricant based on the new knowledge of the present inventors will be also described.

As described above, the new knowledge of the present inventors shows that increasing the amount of charge on toner reaching the image carrier-cleaning member 5 relative to the amount of charge on toner supplied during normal image formation brings about effective and strong removal of lubricant. The main effect of the principle experiment performed by the present inventors will be described below.

Figure 5:
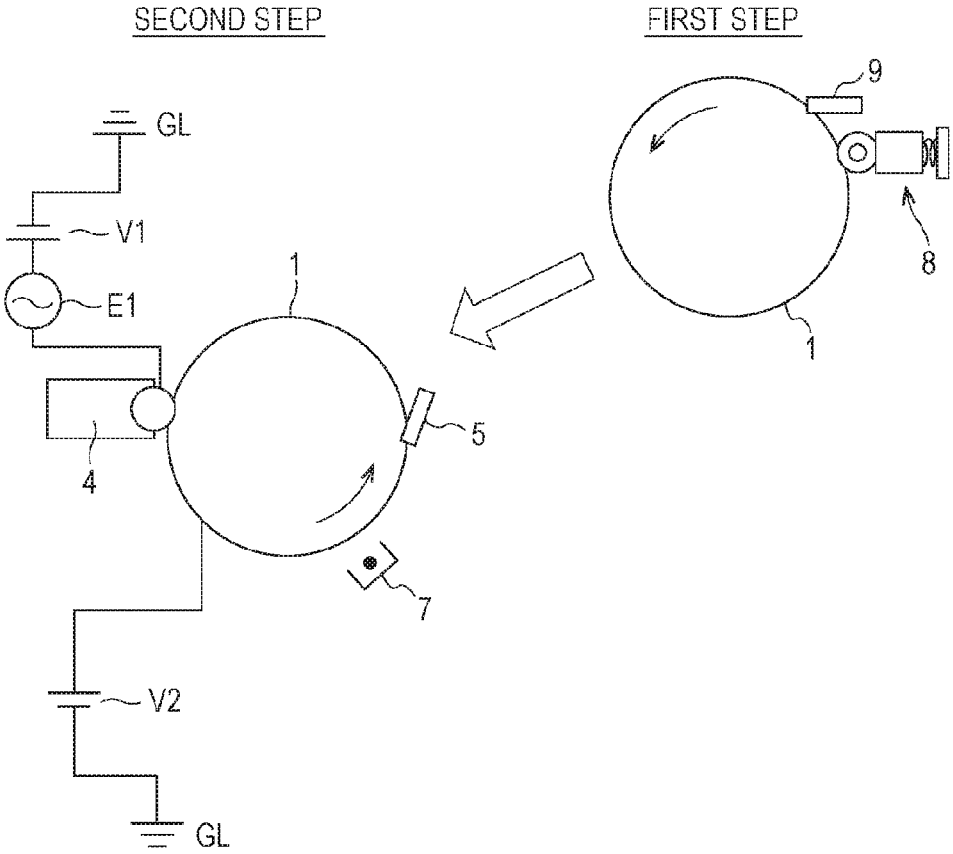
FIG. 5 is a schematic diagram illustrating a configuration used for a principle experiment for verification of a main effect based on new knowledge of the present inventors.

FIG. 5 is a schematic diagram illustrating a configuration used for the principle experiment for verification of the main effect based on the new knowledge of the present inventors. With reference to FIG. 5, a procedure of the principle experiment employed a two-step process including applying lubricant (first step) and then removing the lubricant (second step).

In the first step, lubricant was applied to the photoreceptor 1 a predetermined number of times to form a lubricant layer. In the present experiment, as illustrated in FIG. 5, only the lubricant supply unit 8 and the smoothing member 9 were caused to abut on the photoreceptor 1, and lubricant was applied seven times around the photoreceptor 1.

In the second step, the photoreceptor 1 on which lubricant has been applied in the first step was mounted to a device including the developing unit 4, the auxiliary charging unit 7, and the image carrier-cleaning member 5. As the auxiliary charging unit 7, a corona charger was employed. Then, a toner image was formed on the photoreceptor 1 on which lubricant has been applied. The toner image employed a solid image depositing toner on the whole circumference of the photoreceptor 1, and the toner image was developed only once around the photoreceptor 1. Scraping by the image carrier-cleaning member 5 was performed at the same time. Scraping by the image carrier-cleaning member 5 was performed 30 times around the photoreceptor 1. At this time, a voltage obtained by superimposing an alternating current voltage E1 on a direct current voltage V1 was applied to the developing unit 4, and a direct current voltage V2 is applied to the photoreceptor 1.

The amount of electrical charge applied by the auxiliary charging unit 7 was made different to change the amount of charge on toner, and each lubricant removing effect was evaluated. The evaluation of the lubricant removing effect was performed by quantifying an amount of lubricant on the photoreceptor 1 using Fourier transform infrared (FT-IR). Further, the amount of charge on toner was obtained from the conversion of a transferred charge value and the amount of toner in accordance with the following table, using an ammeter (product name: KEYTHLEY6514 systemelectorometer) connected to the photoreceptor 1. The transferred charge value was obtained by attracting toner passing the auxiliary charging unit 7. Note that, in the following table, applied current represents a value of current applied to passing the auxiliary charging unit 7.

TABLE 1

| APPLIED CURRENT (μA) | AMOUNT OF CHARGE ON TONER (μC/g) |
|---|---|
| 0 | −14 |
| 50 | −20 |
| 75 | −23 |
| 90 | −26 |
| 120 | −30 |
| 200 | −38 |
| 300 | −49 |

Figure 6:
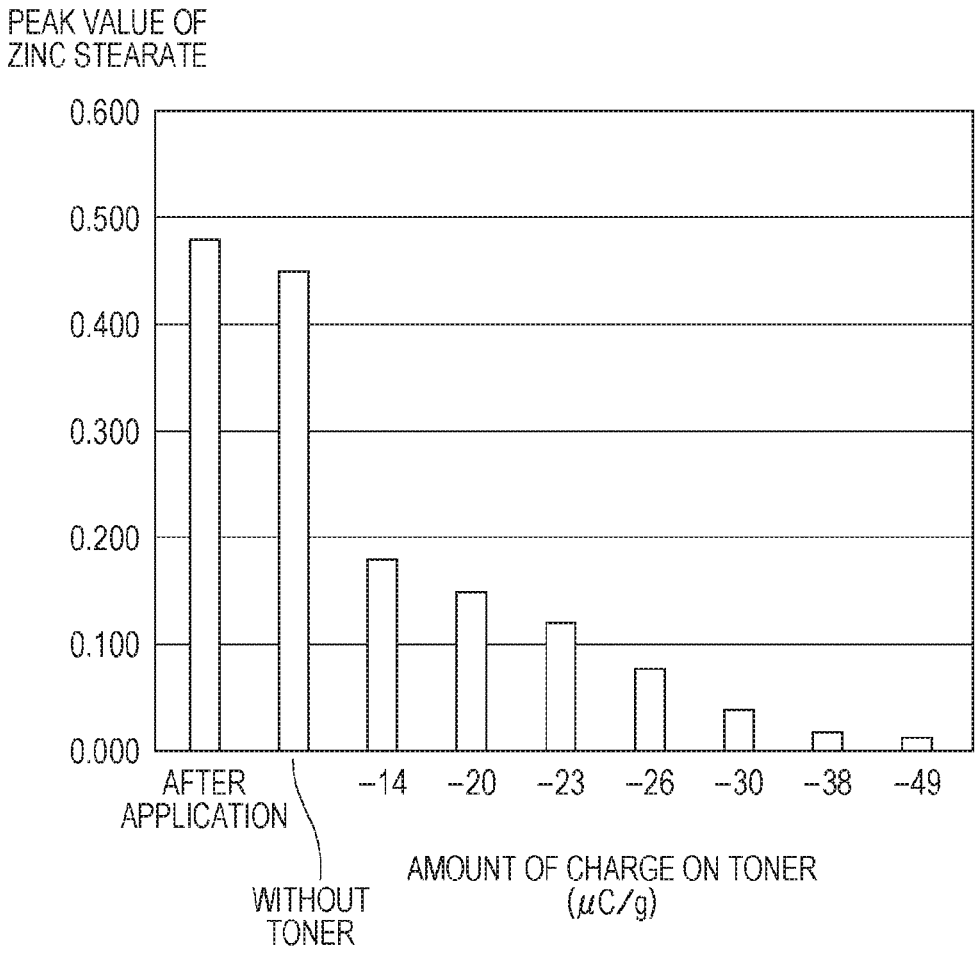
FIG. 6 is a graph illustrating exemplary results of the principle experiment illustrated in FIG. 5.

FIG. 6 is a graph illustrating exemplary results of the principle experiment illustrated in FIG. 5. The vertical axis of the graph of FIG. 6 represents a peak value of zinc stearate measured using FT-IR, being an index indicating the amount of lubricant on the photoreceptor 1. A reduction (difference) from a measurement value of the photoreceptor 1 to which lubricant was applied (result corresponding to "after application" in FIG. 6) represents the lubricant removing effect.

It is found that when the toner image is not formed (result corresponding to "without toner" in FIG. 6), the amount of lubricant on the photoreceptor 1 is not substantially changed. Note that in this case, the experiment was made removing the developing unit 4.

In contrast, it is found that when cleaning is performed after forming the toner image on the lubricant layer (result denoted by numbers (−14, −20, . . . ) as the amount of charge on toner in FIG. 6), lubricant is significantly reduced. It is believed that this is because toner not including lubricant is pressed against a substrate (photoreceptor 1), blocked by the image carrier-cleaning member 5, and makes sliding contact with the substrate (photoreceptor 1), and thus lubricant on the substrate is scraped by the toner.

It is found that the amount of lubricant removed by toner is increased according to the increase of applied current supplied to the auxiliary charging unit 7, and the lubricant is significantly reduced as the amount of charge on toner is increased. As described above, it is found that when the amount of charge on toner supplied to the image carrier-cleaning member 5 is increased, lubricant on the surface of the photoreceptor 1 can be further effectively removed.

The amount of charge on toner used for removing lubricant is preferably increased to some extent relative to the amount of charge on toner used during normal image formation. More specifically, it is preferable that the amount of charge on toner used for removing the lubricant is not more than 90 μC/g, and 1.5 times larger than the amount of charge on toner used during normal image formation, in absolute value.

Figure 7:
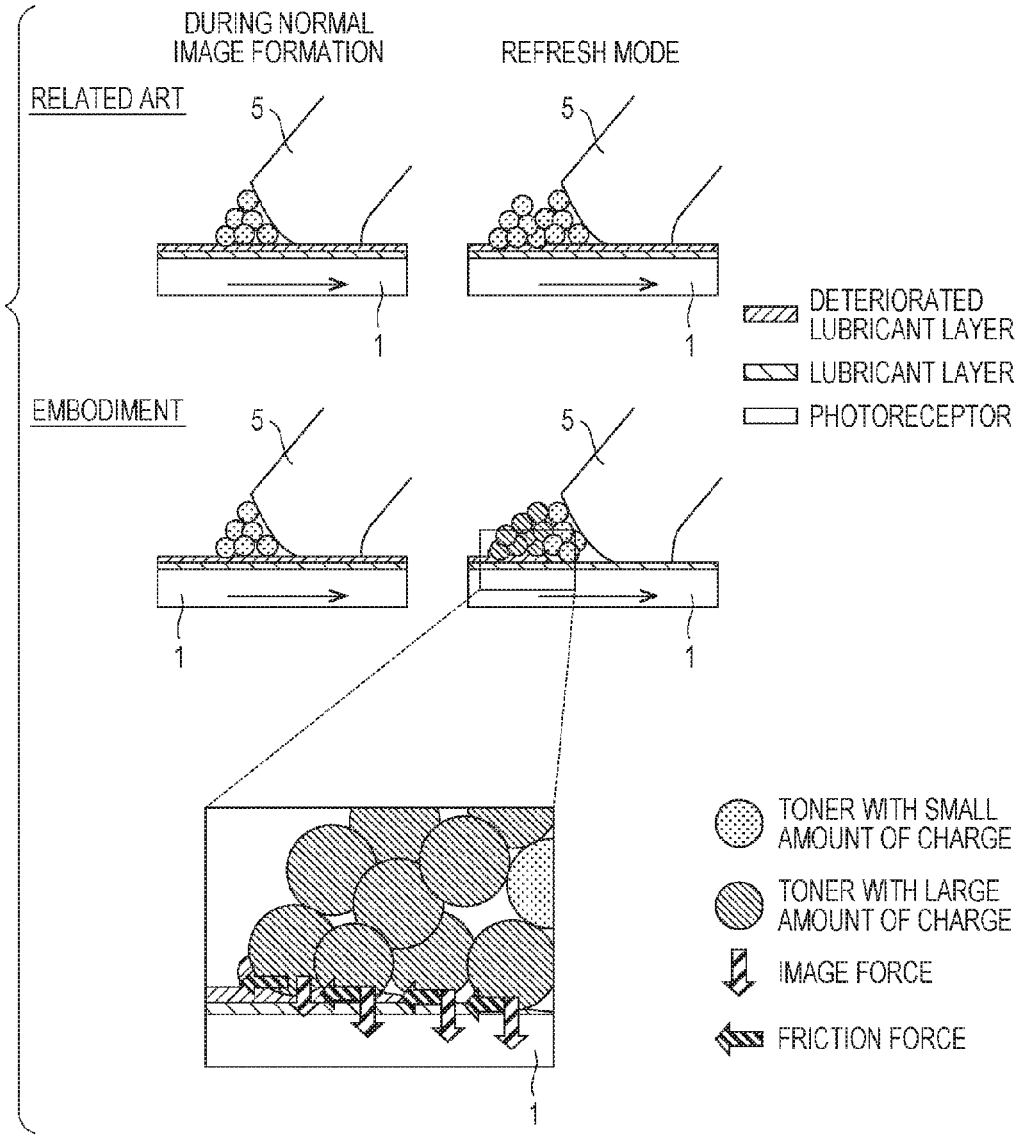
FIG. 7 is a diagram illustrating mechanisms removing lubricant based on new knowledge of the present inventors.

An assumed mechanism showing such a noticeable effect which the present inventors think about will be described. FIG. 7 is a diagram illustrating mechanisms removing lubricant based on the new knowledge of the present inventors.

As illustrated in "related art" of FIG. 7, the amount of charge on toner supplied for normal image formation (printing) can reduce lubricant by a certain amount, but cannot remove the lubricant completely. Thus, even if deteriorated lubricant is present, the deteriorated lubricant cannot be removed completely, and the problems as described above cannot be solved completely.

In contrast, in the present embodiment, increase of the amount of charge on toner increases the amount of lubricant removed by toner. As illustrated in "the present embodiment" of FIG. 7, increase of the amount of charge on toner increases image charge on the toner itself, and strong electrostatic attraction force (i.e., image force) to the photoreceptor 1 is provided. In consequence, the toner is pressed against the photoreceptor 1, and a strong friction force is also applied between the toner and the photoreceptor 1 (see enlarged view of FIG. 7). A drive force of toner for removing lubricant is considered to be caused by the friction force. Therefore, when the amount of charge on toner is increased, the amount of lubricant scraped is considered to be increased relative to the amount of lubricant scraped by the toner supplied during image formation.

When the new knowledge of the present inventors as described above is used, lubricant on the photoreceptor 1 can be effectively and strongly removed. As illustrated in FIG. 7, during normal image formation, lubricant is removed to some extent in an area in which the toner image is formed, but when the new knowledge of the present inventors is used, even the lubricant layer firmly stuck and not removed by toner used during normal image formation (can not be recovered) can be removed.

The function described above can be applied to a system as illustrated in FIG. 4 in which lubricant is added to toner, and the lubricant is supplied on the photoreceptor 1 image carrier) in the developing unit 4, in addition to the configurations illustrated in FIGS. 2 and 3. This is because when the amount of charge on toner is increased, the friction force caused by toner is similarly increased.

An implementation mode is typically preferably provided with a mode supplying a predetermined amount of lubricant, after removal of lubricant on the photoreceptor 1, using the function described above, and before normal image formation. That is, it is preferable that the lubricant layer (lubricant film) deteriorated by discharge product generated in the charging step or the like is appropriately removed, the lubricant removal operation for facilitating reapplication of lubricant is performed, and lubricant supply operation for forming the lubricant layer is performed following the lubricant removal operation. These processing allows image formation while the lubricant layer (lubricant film) is appropriately formed on the photoreceptor 1, and damage on the photoreceptor 1 and the image carrier-cleaning member 5 can be reduced.

Now, a difference between the technology disclosed in JP 2013-101169 A and the new knowledge of the present inventors will be described for confirmation. The technology disclosed in JP 2013-101169 A is configured to remove foreign matter (paper dust, filler, or the like) accumulated in front of the blade using a toner patch. The toner patch may have different condensation degree or amount of charge according to the purpose of removal. However, JP 2013-101169 A does not tell or indicate lubricant formed on the image carrier. Therefore, JP 2013-101169 A cannot lead those skilled in the art to the new knowledge of the present inventors. In the first place, the technology disclosed in JP 2013-101169 A is basically different in the principle (mechanism) of removal. That is, the technology disclosed in JP 2013-101169 A is configured so that the foreign matter prickingly located on the substrate forms a lump with toner, and the lump is removed to remove the foreign matter. This principle of removal is completely different from the new knowledge of the present inventors described above. Further, JP 2013-101169 A has no specific description about the amount of charge, and the amount of charge is not clearly understood.

As described above, the new knowledge of the present inventors is completely different from the technology disclosed in JP 2013-101169 A, and the new knowledge of the present inventors is novel and creative.

G. Implementation Example

A typical implementation example of the above-mentioned new knowledge of the present inventors will be described below.

The image forming apparatus 100 according to the present embodiment has a refresh mode provided separately from a normal image forming mode in which printing is performed. The refresh mode includes a lubricant removal operation facilitating reapplication of lubricant, and a lubricant supply operation forming a lubricant layer. Note that the name "refresh mode" is used for convenience, and this name does not restrict the technical scope of the present invention. For example, the "modes" do not need to be clearly separated, and are preferably implemented to appropriately perform the lubricant removal operation and the lubricant supply operation as described above.

As specific implementation, a charge unit configured to change the amount of charge on toner is provided, separately from the developing unit 4, between the developing unit 4 and the image carrier-cleaning member 5. In a configuration illustrated in FIGS. 2 to 4, the auxiliary charging unit 7 corresponds to the charge unit. The auxiliary charging unit 7 is disposed between the developing unit 4 (development unit) and the image carrier-cleaning member 5 (cleaning unit), along the surface of the photoreceptor 1 (image carrier). The auxiliary charging unit 7 may employ any configuration as far as the amount of charge on toner is controlled, but typically preferably uses a corotron charger or a corona charger. The voltage applied to the auxiliary charging unit 7 may employ direct current voltage, or direct current voltage superimposed on alternating current voltage.

Performance of the normal image forming mode and the refresh mode is controlled by the control unit 50. The control unit 50 is configured to perform a normal image forming mode (first mode) and a cleaning mode (second mode). In the normal image forming mode (first mode), a toner image is formed for the main purpose of normal image formation, that is, transferring the toner image to the medium to which a toner image is to be transferred (intermediate transfer belt 12 and medium S). In the cleaning mode (second mode), the amount of charge on toner reaching the image carrier-cleaning member 5 (cleaning unit) is increased relative to the amount of charge on toner in the normal image forming mode by the auxiliary charging unit 7 (charge unit) for the main purpose of recovering lubricant on the photoreceptor 1 (image carrier).

(g1: Control of Amount of Lubricant Supplied)

During the lubricant removal operation in the refresh mode, the amount of lubricant supplied onto the photoreceptor 1 is preferably reduced or reduced to zero. That is, the control unit 50 controls the lubricant supply mechanism (lubricant supply unit) so that lubricant is controllably supplied in the refresh mode. Since the amount of lubricant supplied is controlled as described above, the lubricant can be further effectively removed.

As a specific configuration controlling the amount of lubricant supplied, in a configuration provided with the lubricant supply mechanism (e.g., lubricant supply unit 8 and smoothing member 9 illustrated in FIG. 2) separately from the developing unit 4, a pressure contact force of the lubricant supply unit 8 to the photoreceptor 1 may be reduced, or the lubricant supply unit 8 may be separated from the photoreceptor 1.

In a configuration using the application brush 81 to scrape lubricant from the solid lubricant 84 and applying the lubricant to the photoreceptor 1, as the lubricant supply unit 8 illustrated in FIGS. 2 and 3, the amount of lubricant supplied can be also controlled by reducing the rotational speed of the application brush 81 and/or reducing the pressure contact force of the application brush 81 to the solid lubricant 84

(g2: Image Pattern in Refresh Mode)

During performance of the refresh mode, a toner image expressing a predetermined image pattern is formed on the photoreceptor 1 by the developing unit 4. The image pattern having toner over a rotational axis direction is preferably used. Such an image pattern may use, for example, a solid pattern having toner over the rotational axis direction. That is, the control unit 50 uses the image pattern having toner over the rotational axis direction of the photoreceptor 1 as the image carrier, in the refresh mode. However, the image pattern is not limited to the solid pattern, and may be a halftone dot pattern, or may be a whole pale solid pattern formed by controlling development bias.

(g3: Control of Transfer Condition in Refresh Mode)

The toner image (image pattern) formed at the developing unit 4 comes into contact with the intermediate transfer belt 12. At this time, transfer condition is preferably controlled to increase the amount of toner supplied to the image carrier-cleaning member 5 relative to the amount of toner supplied during normal image formation, e.g., to reduce the amount of toner transferred to the intermediate transfer belt 12. More specifically, in the refresh mode, the control unit 50 controls the transfer condition in the intermediate transfer body contact roller 6 and a related portion (transfer unit) to increase the amount of toner reaching the image carrier-cleaning member 5, relative to the amount of toner reaching the image carrier-cleaning member 5 during normal image formation. Means of controlling such transfer condition effectively controls the transfer bias. For example, means of reducing a transfer electric field relative to the transfer bias during normal image formation, or controlling the transfer bias to reverse the polarity of the transfer electric field, can increase the amount of toner reaching the image carrier-cleaning member 5, relative to the amount of toner supplied during normal image formation.

Additionally, other means of controlling the transfer condition may control a pressure contact force during transfer. More specifically, during performance of the refresh mode, means of, for example, reducing the pressure contact force of the intermediate transfer body contact roller 6, relative to the pressure contact force during normal image formation, or separating the intermediate transfer body contact roller 6 from the intermediate transfer belt 12 maybe employed.

(g4: Adjustment of Amount of Charge in Refresh Mode)

A certain amount of charge is applied to the toner image on the photoreceptor 1 passing the intermediate transfer belt 12, by the auxiliary charging unit 7 (charge unit) disposed in front of the image carrier-cleaning member 5. The amount of electrical charge applied by the auxiliary charging unit 7 is set to be larger than the amount of electrical charge during normal image formation. More specifically, voltage having the same polarity as normal polarity of electrical charge on toner (polarity of electrical charge held during image formation) is applied to the auxiliary charging unit 7 to increase the amount of charge on toner while maintaining the normal polarity of electrical charge on toner.

The auxiliary charging unit 7 may be configured to apply electrical charge only during performance of the refresh mode, or in order to control the condition of the toner image formed during normal image formation, the auxiliary charging unit 7 may be configured to apply electrical charge also during normal image formation. When the auxiliary charging unit 7 applies electrical charge also during normal image formation, the refresh mode requires stronger (applied voltage higher in absolute value and/or larger current supplied to the auxiliary charging unit 7) electrical charge, relative to the electrical charge during normal image formation. Therefore, toner having a larger amount of charge relative to the amount of charge on toner during normal image formation is supplied to the image carrier-cleaning member 5.

The control unit 50 controls, in any manner as described above, the amount of charge on toner reaching the image carrier-cleaning member 5 in the refresh mode to be larger than the amount of charge on toner reaching the image carrier-cleaning member 5 during normal image formation. Preferably, the auxiliary charging unit 7 is controlled to have an amount of charge on toner reaching the image carrier-cleaning member 5 in the refresh mode of not more than 90 μC/g, and 1.5 times larger than the amount of charge on toner reaching the image carrier-cleaning member 5 during normal image formation, in absolute value.

(g5: End Processing of Lubricant Removal Operation in Refresh Mode)

When a predetermined amount of toner is determined to be supplied to the image carrier-cleaning member 5, the photoreceptor 1 is preferably rotated a predetermined number of times, after supply of toner and electrical charge applied by the auxiliary charging unit 7 are finished. This rotation reduces unevenness in amount of lubricant applied, in the rotational axis direction.

(g6: Lubricant Supply Operation in Refresh Mode)

After the lubricant removal operation in the refresh mode is finished, operation for supplying lubricant on the photoreceptor 1 (lubricant supply operation) is preferably performed before returning to the normal image formation. That is, in the refresh mode, the control unit 50 controls the lubricant supply mechanism (lubricant supply unit) to form a lubricant layer on the photoreceptor 1, following the recovery of lubricant on the photoreceptor 1 (image carrier). Performance of the lubricant supply operation following the lubricant removal operation allows image formation while a lubricant layer (lubricant film) having an appropriate amount is formed all over the area in which the toner image is formed, and thus, the lives of the photoreceptor 1 and the image carrier-cleaning member 5 can be extended.

In a configuration provided with the lubricant supply mechanism separately from the developing unit 4 (e.g., lubricant supply unit 8 and smoothing member 9 illustrated in FIG. 2), the lubricant supply operation includes stopping supply of toner by the developing unit 4, bringing the lubricant supply unit 8 into pressure contact with the photoreceptor 1, and rotating the photoreceptor 1 a predetermined number of times. At this time, contrary to the lubricant removal operation, pressure contact force of the application brush 81 to the solid lubricant 84 is increased, and/or the rotational speed of the application brush 81 is increased, and thus, the lubricant can be supplied to an appropriate area of the photoreceptor 1 more effectively, that is, with a reduced number of rotation of the photoreceptor 1.

H. Start Condition for Refresh Mode

Some of the start conditions for the refresh mode according to the present embodiment will be described below. The refresh mode is started basically when determined that the lubricant layer is determined to be deteriorated. That is, when the predetermined start condition is satisfied, the control unit 50 performs processing relating to the refresh mode. The start condition is associated with the number of printed sheets, an image pattern used for printing, a history of printing, or the like.

(h1: Start Condition Relating to Number of Printed Sheets)

The refresh mode (lubricant removal operation and lubricant supply operation) is preferably performed, for example, each time a predetermined number of sheets are printed. That is, the start condition for the refresh mode includes arrival of the number of toner images formed on the photoreceptor 1 to a predetermined value, during normal image formation. The refresh mode is repeatedly performed each time the predetermined number of sheets are printed, and stable image formation can be achieved for a long time. Further, the refresh mode may be performed as part of processing (start sequence) performed upon power-on of the image forming apparatus 100 (or upon returning from a power-saving mode), or part of processing (end sequence) performed upon power-off of the image forming apparatus 100 (or upon transferring to power-saving mode).

(h2: Start Condition in Consideration of Image Pattern Dependency in Lubricant Deterioration (Part 1))

The lubricant deterioration and failure caused by the deterioration also depend on the image pattern formed during normal image formation. Thus, the operation in the refresh mode may be appropriately adjusted according to the image pattern formed during normal image formation.

Figure 8A:
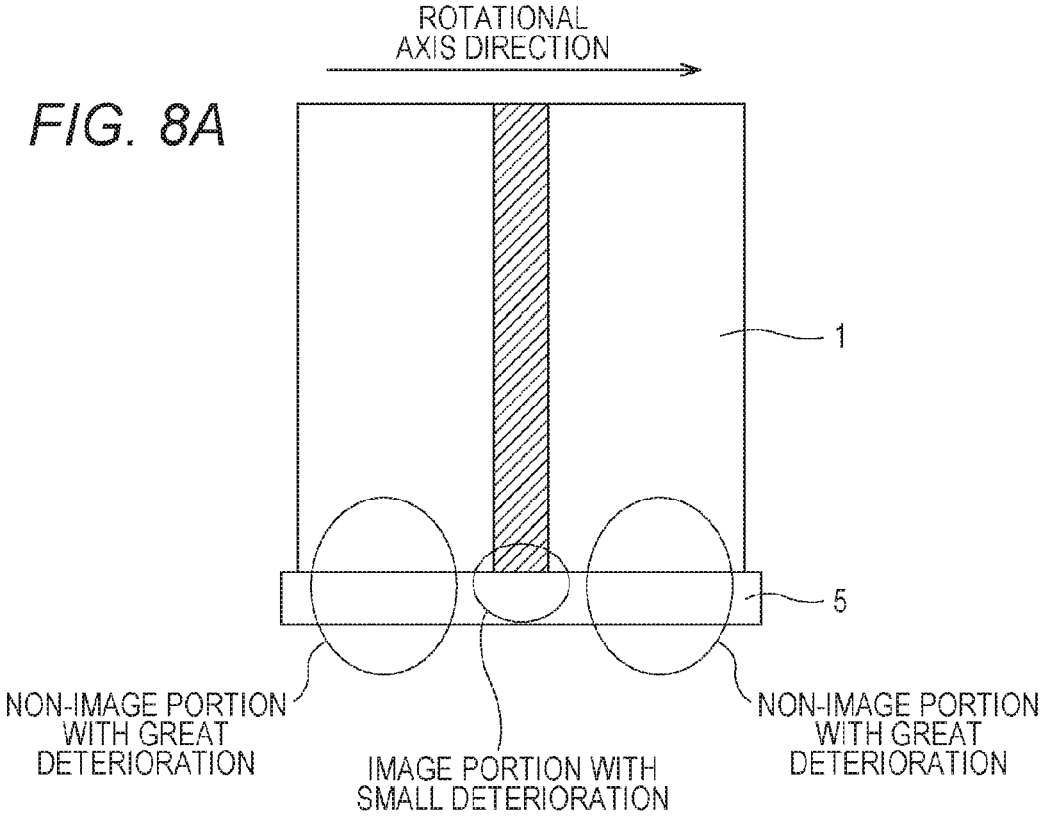
FIGS. 8A and 8B are diagrams illustrating an exemplary image pattern used in a refresh mode according to the present embodiment.
Figure 8B:
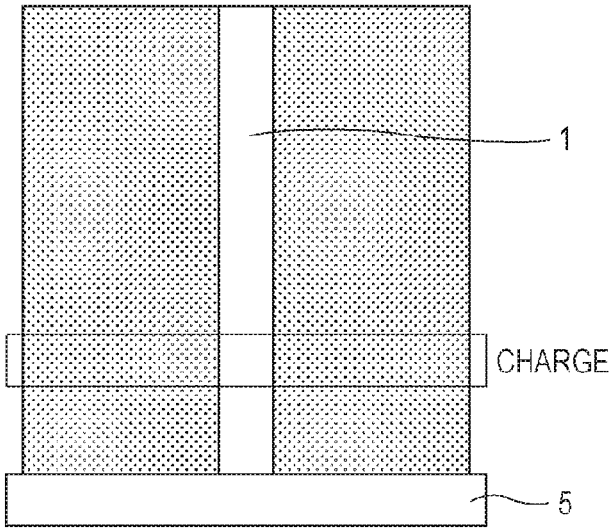

FIGS. 8A and 8B are diagrams illustrating an exemplary image pattern used in a refresh mode according to the present embodiment. FIG. 8A illustrates image formation of a vertical band chart as the image pattern. In the vertical band chart illustrated in FIG. 8A, toner exists only in a partial area (image portion) in the rotational axis direction, and toner does not exist in the remaining areas (non-image portion). Therefore, toner is continuously supplied selectively only to a specific area (image portion) of the image carrier-cleaning member 5.

During normal image formation, some lubricant on the photoreceptor 1 is also scraped by toner supplied to the image carrier-cleaning member 5, and thus, the image formation is repeated on the area corresponding to the image portion, while removing the lubricant to some extent.

In contrast, toner is not supplied to the image carrier-cleaning member 5, and thus, the non-image portion has no little removal function for lubricant on the photoreceptor 1.

That is suggested by the graph of FIG. 6 indicting exemplary results of the principle experiment. Therefore, in the area corresponding to the non-image portion, lubricant is not removed, and the deterioration lubricant is notably accumulated. That is, the lubricant deterioration occurs to some extent selectively at the non-image portion. This means that when the same image pattern is successively printed, lubricant is notably deteriorated in the non-image portion, and failure caused by the deterioration also tends to occur.

Based on such a knowledge, the start condition for the refresh mode according to the present embodiment preferably includes the number of sheets on which the same image pattern is successively printed. That is, the start condition for the refresh mode includes continuous formation of the same image pattern a predetermined number of times during normal image formation. Specifically, the control unit 50 of the image forming apparatus 100 (FIG. 1) stores image patterns used for image formation, and counts the number of printed sheets for each image pattern. The refresh mode as described above may be started when the same image pattern is successively printed on a predetermined number of sheets. Note that once the refresh mode is performed, a count value representing the number of sheets on which the image pattern is successively printed is reset to zero, and the normal image formation is preferably performed from an initial state.

Employment of such start condition allows stable image formation even if the same image pattern is successively printed, that is, even if lubricant is likely to have local deterioration. Note that also in the refresh mode performed at this time, the amount of charge on toner reaching the image carrier-cleaning member 5 is increased relative to the amount of charge on toner supplied during normal image formation.

Further, when the same image pattern is successively printed on a predetermined number of sheets as described above, a main purpose is removing lubricant in the non-image portion. Therefore, lubricant in the non-image portion may be selectively removed. Typically, a negative pattern having an inverted black-and-white image of an image pattern which is successively printed on a predetermined number of sheets is preferably set to an image pattern in the refresh mode. That is, the control unit 50 uses the negative pattern obtained by inverting black and white of the same image pattern, in the refresh mode.

For example, when the image pattern (vertical band chart) as illustrated in FIG. 8A is successively printed on a predetermined number of sheets, a negative pattern having an inversion of the image portion and the non-image portion, as illustrated in FIG. 8B, is used as an image pattern. When the negative pattern of such an image pattern successively printed is used, the amount of toner used can be saved, compared with use of an image pattern having uniform toner over the rotational axis direction. Further, lubricant locally deteriorated can be effectively removed at a necessary frequency, compared with performance of the refresh mode each time a predetermined number of sheets are printed.

(h3: Start Condition in Consideration of Image Pattern Dependency in Lubricant Deterioration (Part 2))

Another exemplary processing may be configured so that a plurality of areas are set along the rotational axis direction of the photoreceptor 1, an integrated print density value is calculated for each area, and when a difference in integrated print density value between the areas exceeds a predetermined threshold value, the refresh mode is started.

Figure 9A:
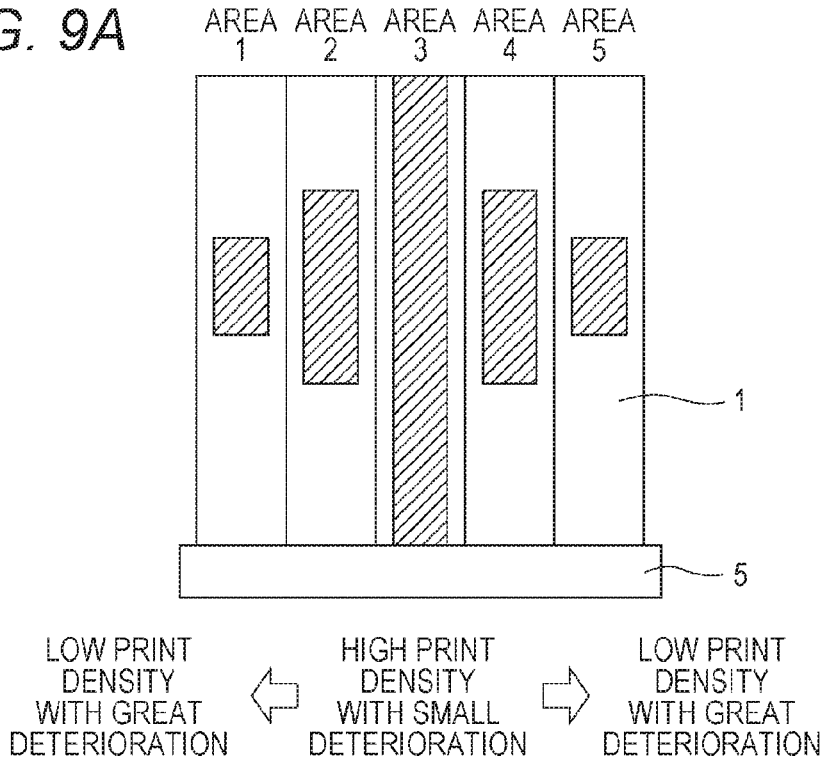
FIGS. 9A and 9B are diagrams illustrating another exemplary image pattern used in a refresh mode according to the present embodiment.
Figure 9B:
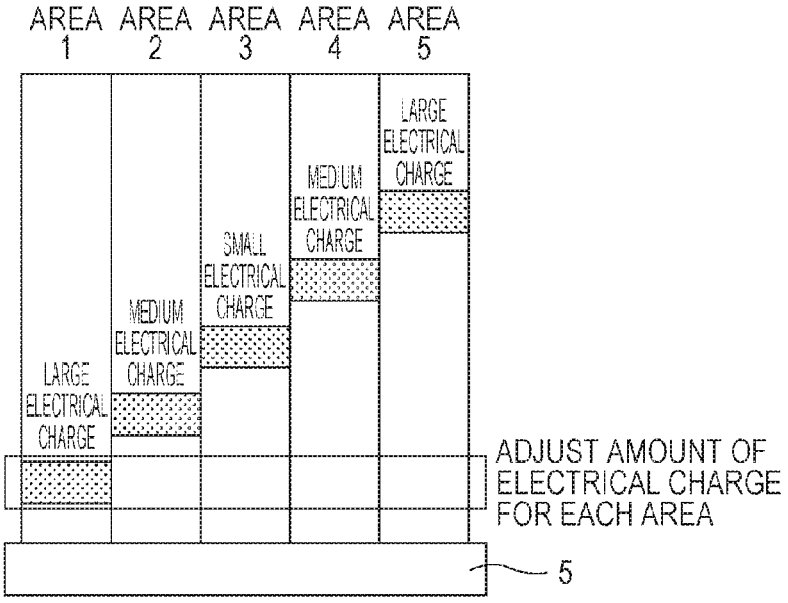

FIGS. 9A and 9B are diagrams illustrating another exemplary image pattern used in the refresh mode according to the present embodiment. FIG. 9A illustrates an example of a toner application degree on the photoreceptor 1 (hereinafter, also referred to as "print density"). A value obtained by integrating printing densities each time of printing for respective areas is provided as the integrated print density value. In an example illustrated in FIG. 9A, an area around the center of the rotational axis direction (area 3) has a high print density, and the print density is reduced toward a periphery. As described above, since some lubricant is scraped from the area to which a sufficient amount of toner is supplied during normal image formation, lubricant has a small degree of deterioration. In contrast, in the area to which a small amount of toner is supplied during normal image formation, lubricant has a relatively great degree of deterioration.

Based on such knowledge, the start condition for refresh mode according to the present embodiment preferably includes the integrated print density value calculated for a plurality of areas set along the rotational axis direction of the photoreceptor 1. That is, the start condition for the refresh mode includes excess of a difference in the integrated print density value over a predetermined value between any two areas, the integrated print density value during the normal image formation being calculated for each of the plurality of areas set along the rotational axis direction of the photoreceptor 1 (image carrier). Specifically, the control unit 50 of the image forming apparatus 100 (FIG. 1) calculates the print density for each area and sequentially integrates the printing densities, according to the image pattern used for image formation, and the integrated print density value is calculated for each area. Then, when a difference in integrated print density value between the areas exceeds the predetermined threshold value, the refresh mode may be started. Note that once the refresh mode is performed, each integrated print density value is reset to zero, and the normal image formation is preferably performed from the initial state.

Further, when such a start condition is employed, a distribution pattern of the amount of electrical charge in the refresh mode may be determined according to the integrated print density value in each area. For example, as illustrated in FIG. 9B, since an area having a relatively high integrated print density value seems to have a relatively small degree of lubricant deterioration, the amount of charge on toner in the corresponding area reaching the image carrier-cleaning member 5 is reduced in increasing degree (small electrical charge), and since an area having a relatively small integrated print density value seems to have a relatively great degree of lubricant deterioration, the amount of charge on toner in the corresponding area reaching the image carrier-cleaning member 5 is increased in increasing degree (large electrical charge) That is, the control unit 50 adjusts the amount of electrical charge applied along the rotational axis direction of the photoreceptor 1 (image carrier) by the auxiliary charging unit 7 (charge unit), according to the integrated print density value of each of the plurality of areas. As described above, an image pattern increasing the amount of electrical charge on an area having a relatively small print density may be formed to selectively scrape lubricant having a great degree of deterioration.

When such a control method is employed, image formation is stably performed, even if the integrated print density value varies, that is, even if lubricant deterioration is likely to be locally generated.

Note that the image pattern used in the refresh mode needs to be formed according to each control method to selectively perform recovery of lubricant as described above, but the density of the toner image is not particularly limited. As described above, the image pattern may be a halftone dot pattern, or may be a whole pale solid pattern formed by controlling the development bias. Further, the lubricant removal operation and the lubricant supply operation on the photoreceptor 1 are similar to the processing described above.

I. Processing Procedure

Next, a processing procedure relating to the refresh mode according to the present embodiment will be described. Several variations of the start condition will be described below.

(i1: Starting Based on Number of Printed Sheets)

Figure 10:
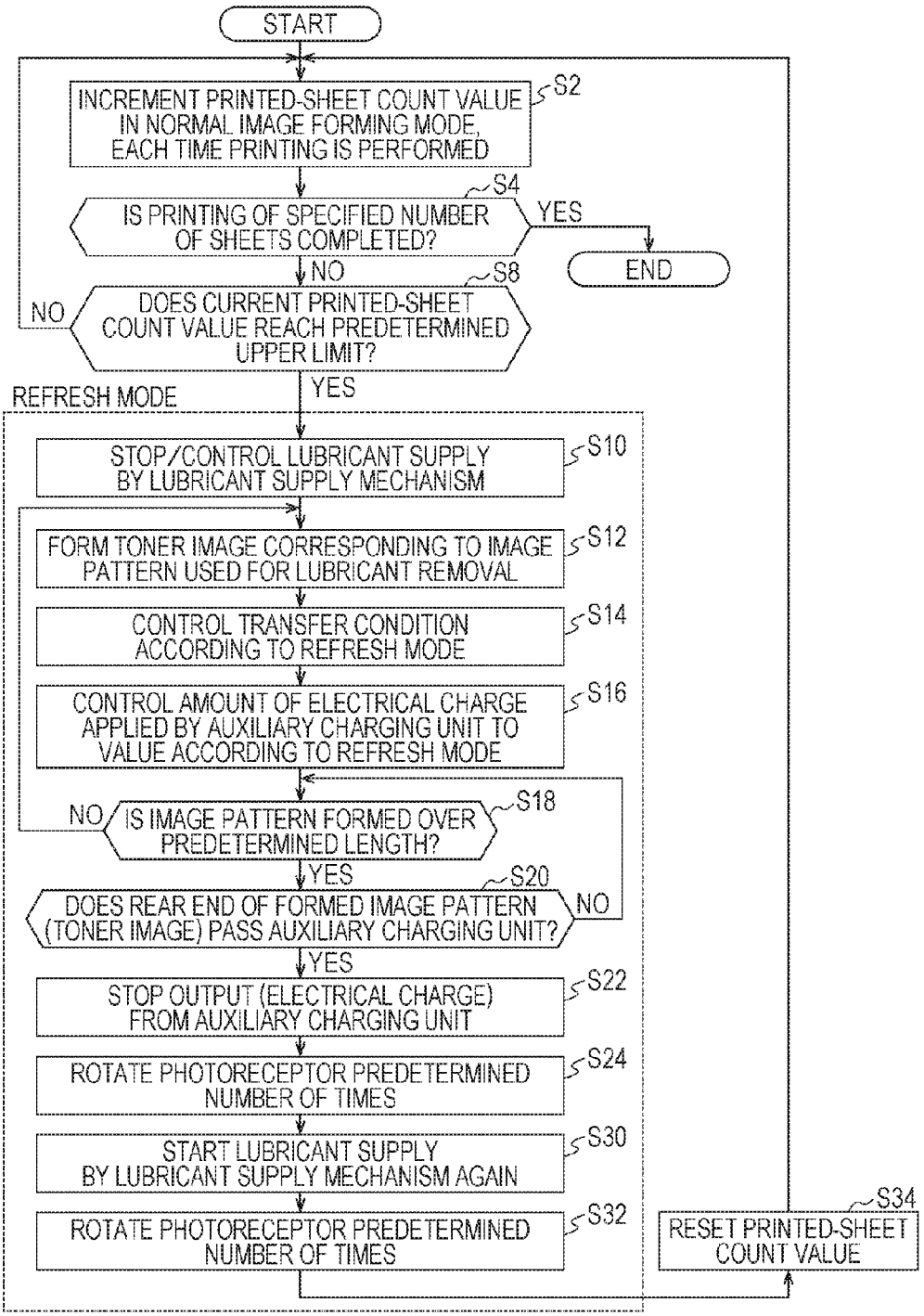
FIG. 10 is a flowchart illustrating a processing procedure according to a refresh mode in an image forming apparatus according to the present embodiment.

FIG. 10 is a flowchart illustrating a processing procedure according to the refresh mode in the image forming apparatus 100 according to the present embodiment. Each step illustrated in FIG. 10 is typically performed by executing a program previously installed by the control unit 50.

FIG. 10 illustrates an exemplary process of starting the refresh mode based on the number of printed sheets without depending on the image pattern used for normal image formation. More specifically, the control unit 50 increments a printed-sheet count value, in the normal image forming mode, each time printing (image formation) is performed (step S2). In step S2, for the main purpose of transferring the toner image to the medium to which a toner image is to be transferred (intermediate transfer belt 12 and medium S), a toner image is formed on the photoreceptor 1. When printing a specified number of sheets is completed (YES in step S4), the control unit 50 finishes printing.

When printing the specified number of sheets is not completed (NO in step S4), the control unit 50 determines whether a current printed-sheet count value reaches a predetermined upper limit (step S8). When the current printed-sheet count value does not reach the predetermined upper limit (NO in step S8), the process repeats step S2 and subsequent steps.

In contrast, when the current printed-sheet count value reaches the predetermined upper limit (YES in step S8), the refresh mode is started.

In FIG. 10, the processing of steps S10 to S24 corresponds to the lubricant removal operation, and the processing of steps S30 to S32 corresponds to the lubricant supply operation.

First, the control unit 50 stops or controls lubricant supply by the lubricant supply mechanism (step S10) Typically, as described in (g1: Control of amount of lubricant supplied), the control unit 50 reduces the pressure contact force of the lubricant supply unit 8 to the photoreceptor 1, or separates the lubricant supply unit 8 from the photoreceptor 1. Then, the control unit 50 determines an image pattern used for lubricant removal, and forms a toner image corresponding to the image pattern, at an appropriate position on the photoreceptor 1 (step S12). Typically, as described in (g2: Image pattern in refresh mode), a solid pattern is used.

At substantially the same time as processing of step S12, the control unit 50 controls the transfer condition according to the refresh mode (step S14). Typically, as described in (g3: Control of transfer condition in refresh mode), the control unit 50 adjusts the transfer condition to increase the amount of toner supplied to the image carrier-cleaning member 5 relative to the amount of toner supplied during normal image formation. Further, the control unit 50 controls the amount of electrical charge applied by the auxiliary charging unit 7 to a value according to the refresh mode (step S16). Typically, as described in (g4: Adjustment of amount of charge in refresh mode), current (charger current) applied to the auxiliary charging unit 7 is changed to a value according to the refresh mode. That is, in step S16, for the main purpose of recovering lubricant on the photoreceptor 1 (image carrier), the auxiliary charging unit 7 (charge unit) increases the amount of charge on toner reaching the image carrier-cleaning member 5 relative to that for the main purpose of transferring the toner image to the medium to which a toner image is to be transferred. The auxiliary charging unit 7 is disposed between the developing unit 4 and the image carrier-cleaning member 5 (cleaning unit), along the surface of the photoreceptor 1.

The control unit 50 determines whether the image pattern used for lubricant removal is formed over a predetermined length (step S18). When the image pattern used for lubricant removal is not formed over a predetermined length (NO in step S18), the process repeats step S12 and subsequent steps. That is, the image pattern used for lubricant removal during non-image formation is formed on the photoreceptor 1, over a predetermined length. Note that the number of printed sheets (threshold value) being the start condition for the refresh mode, an image area rate of the image pattern, and circumferential length of the toner image are set appropriately according to a characteristic value of toner loaded into the image forming apparatus 100, a characteristic value of the photoreceptor 1, or the like.

When the image pattern used for lubricant removal is formed for the predetermined length (YES in step S18), the control unit 50 determines whether a rear end of the formed image pattern (toner image) passes the auxiliary charging unit 7 (step S20). When the rear end of the formed toner image does not passes the auxiliary charging unit 7 (NO in step S20), processing of step S18 is repeated. When the rear end of the formed toner image passes the auxiliary charging unit 7 (YES in step S20), output (electrical charge) from the auxiliary charging unit 7 is stopped (step S22). Note that steps S20 and S22 are optional processing, and are implemented as required. However, when the electrical charge is continuously applied from the auxiliary charging unit 7, discharge product may adhere on the surface of the photoreceptor 1 or lubricant may be deteriorated in the refresh mode. Therefore, processing of steps S20 and S22 is preferably implemented.

Then, the control unit 50 rotates the photoreceptor 1 a predetermined number of times (step S24). When the photoreceptor 1 is rotated, a certain amount of toner of the toner image formed on the surface of the photoreceptor 1 stays at an edge portion of the image carrier-cleaning member 5 (cleaning blade), and the toner slidingly scrapes the photoreceptor 1 to recover lubricant. Note that the rotational speed and the total number of rotations of the photoreceptor 1 are set appropriately according to a characteristic value of toner loaded into the image forming apparatus 100, a characteristic value of the photoreceptor 1, and a characteristic value (including abutment condition or the like) of the image carrier-cleaning member 5 (cleaning blade). Note that reference can be made also to (g5: End processing of lubricant removal operation in refresh mode) having been described above.

The processing of steps S10 to S24 having been described above corresponds to the lubricant removal operation. Next, the lubricant supply operation is started.

More specifically, the control unit 50 starts the lubricant supply by the lubricant supply mechanism again (step S30). As described in (g6: Lubricant supply operation in refresh mode), lubricant needs to be applied again, and the amount of lubricant to be applied is further increased to reduce a time require for lubricant application. The control unit 50 rotates the photoreceptor 1 a predetermined number of times (step S32). When the photoreceptor 1 is rotated, lubricant supplied by the lubricant supply mechanism forms the lubricant layer. When a predetermined number of rotations of the photoreceptor 1 is completed, the refresh mode ends, and the refresh mode is returned to the normal image forming mode.

When the refresh mode is returned to the normal image forming mode, the control unit 50 resets the printed-sheet count value to zero (step S34). Note that an objective value of the number of printed sheets being a condition for starting a next refresh mode may be set, instead of resetting the printed-sheet count value to zero. When the refresh mode is returned to the normal image forming mode, various conditions are returned to normal values.

(i2: Starting in Consideration of Image Pattern Dependency (Part 1))

Figure 11:
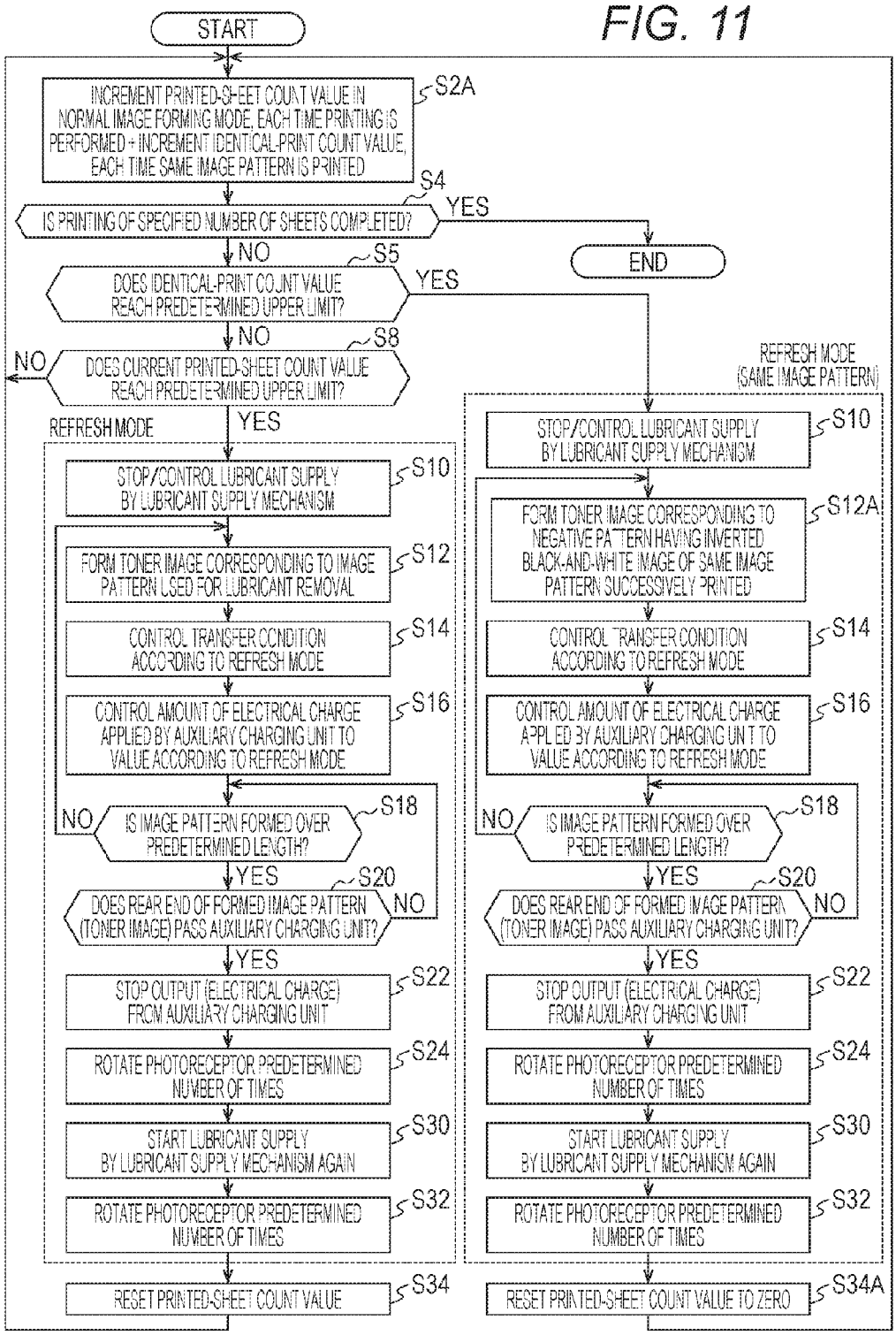
FIG. 11 is a flowchart illustrating another processing procedure according to a refresh mode in an image forming apparatus according to the present embodiment.

As described above, the refresh mode may be started in consideration of the image pattern dependency. FIG. 11 is a flowchart illustrating another processing procedure according to a refresh mode in an image forming apparatus 100 according to the present embodiment. In addition to the processing procedure illustrated in FIG. 10, the processing procedure illustrated in FIG. 11 represents an example of starting a refresh mode upon successive printing of the same image pattern on a predetermined number of sheets. This added refresh mode will be referred to as "refresh mode (the same image pattern)" for the purpose of illustration. Processing substantially the same as the processing illustrated in FIG. 10 is designated by the same step number.

With reference to FIG. 11, the control unit 50 holds or updates an identical-print count value counting the number of sheets on which the same image pattern is successively printed. More specifically, in the normal image forming mode, the control unit 50 increments the printed-sheet count value, each time printing (image formation) is performed, and increments the identical-print count value, each time the same image pattern is printed (image formation) (step S2A). The control unit 50 determines whether the identical-print count value reaches a predetermined upper limit (step S5), and starts the refresh mode (the same image pattern), when the identical-print count value reaches the predetermined upper limit. Further, the control unit 50 determines whether the printed-sheet count value reaches a predetermined upper limit (step S8), and starts the refresh mode (refresh mode illustrated in FIG. 10), when the printed-sheet count value reaches the predetermined upper limit.

Detailed description of the refresh mode, which is performed when the printed-sheet count value reaches the predetermined upper limit (YES in step S8), is not repeated since the refresh mode has been described with reference to FIG. 10.

The refresh mode (the same image pattern) will be described below in terms of difference from the refresh mode of FIG. 10. The control unit 50 stops or controls the lubricant supply performed by the lubricant supply mechanism (step S10). Then, the control unit 50 determines a negative pattern having an inverted black-and-white image of the same image pattern which is successively printed on the predetermined number of sheets, as an image pattern used for lubricant removal, and forms a toner image corresponding to the image pattern, at an appropriate position on the photoreceptor 1 (step S12A). Then, the process performs step S14 and subsequent steps.

When the same image pattern is successively printed on the predetermined number of sheets lubricant is notably partially deteriorated (in particular, deterioration of lubricant in an area corresponding to a non-image portion), and the refresh mode is performed using the negative pattern of the same image pattern to effectively remove the lubricant.

Sequential performance of the successive refresh mode (the same image pattern) is completed, the refresh mode is returned to the normal image forming mode. When the refresh mode is returned to the normal image forming mode, the control unit 50 resets the identical-print count value to zero (step S34A). Note that an objective value of the number of printed sheets being a condition for starting a next refresh mode may be set, instead of resetting the identical-print count value to zero. When the refresh mode is returned to the normal image forming mode, various conditions are returned to normal values.

(i3: Starting in Consideration of Image Pattern Dependency (Part 2))

Figure 12:
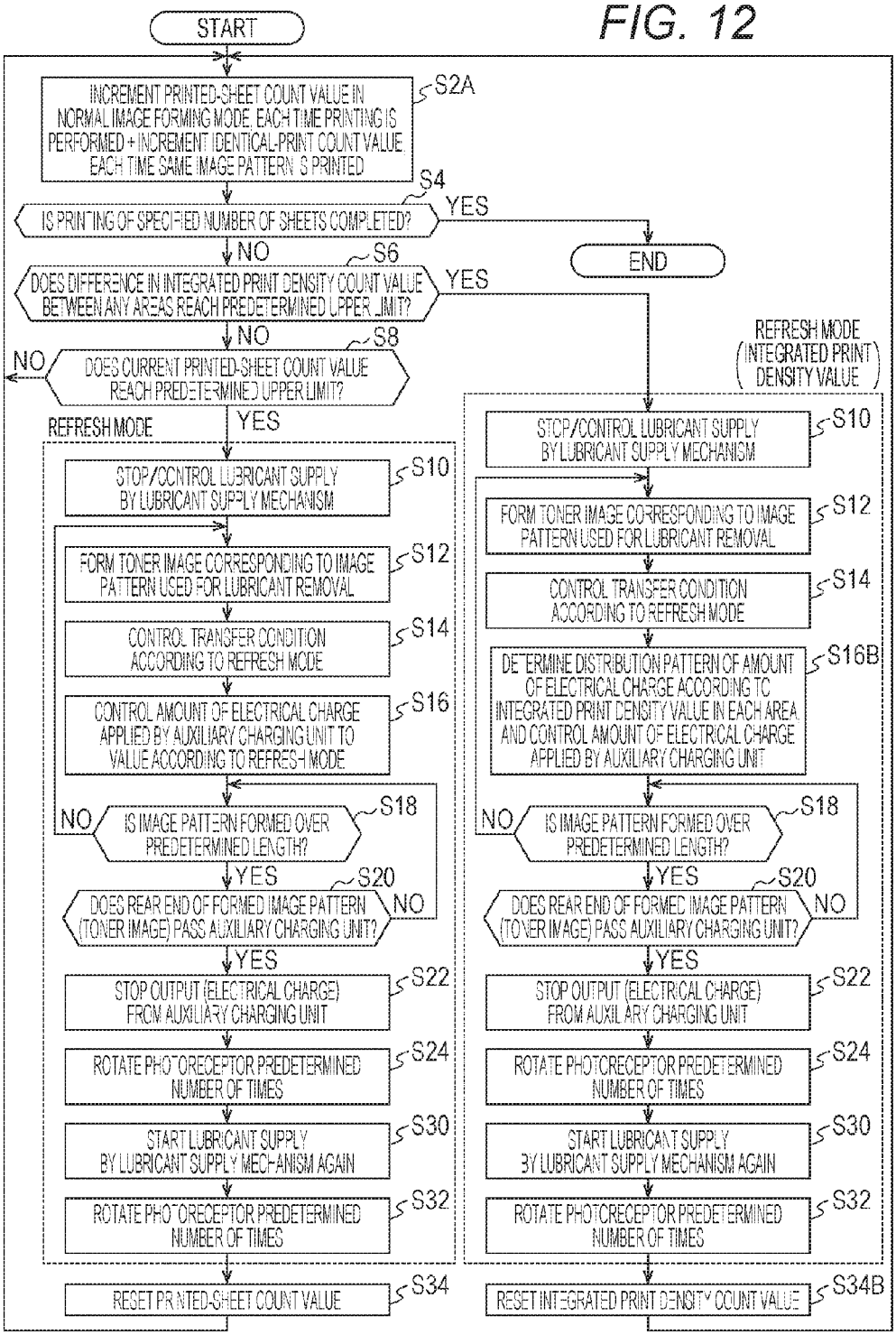
FIG. 12 is a flowchart illustrating a still another processing procedure according to a refresh mode in an image forming apparatus according to the present embodiment.

The refresh mode may be started in consideration of the image pattern dependency in another mode. FIG. 12 is a flowchart illustrating a still another processing procedure according to a refresh mode in an image forming apparatus 100 according to the present embodiment. In addition to the processing procedure illustrated in FIG. 10, the processing procedure illustrated in FIG. 12 represents an example of starting a refresh mode in which a plurality of areas are set along the rotational axis direction of the photoreceptor 1, the integrated print density value is calculated for each area, and when a difference in integrated print density value between the areas exceeds a predetermined threshold value, the refresh mode is started. This added refresh mode will be referred to as "refresh mode (integrated print density value)" for the purpose of illustration. Processing substantially the same as the processing illustrated in FIG. 10 is designated by the same step number.

With reference to FIG. 12, the control unit 50 holds and updates an integrated print density count value representing the integrated print density value for each area. More specifically, in the normal image forming mode, the control unit 50 increments the printed-sheet count value, each time printing (image formation) is performed, and updates the integrated print density count value for each area based on an image pattern (step S2B).

The control unit 50 determines whether a difference in integrated print density count value between any areas reaches a predetermined upper limit (step S6), and starts the refresh mode (integrated print density value), when the difference reaches a predetermined upper limit. Further, the control unit 50 determines whether the printed-sheet count value reaches a predetermined upper limit (step S8), and starts the refresh mode (refresh mode illustrated in FIG. 10), when the printed-sheet count value reaches the predetermined upper limit.

Detailed description of the refresh mode, which is performed when the printed-sheet count value reaches the predetermined upper limit (YES in step S8), is not repeated since the refresh mode has been described with reference to FIG. 10.

The refresh mode (integrated print density value) will be described below in terms of difference from the refresh mode of FIG. 10. The control unit 50 stops or controls the lubricant supply performed by the lubricant supply mechanism (step S10). Then, the control unit 50 determines an image pattern used for lubricant removal, and forms a toner image corresponding to the image pattern, at an appropriate position on the photoreceptor 1 (step S12). Further, the control unit 50 controls the transfer condition according to the refresh mode (step S14). Further, the control unit 50 determines a distribution pattern of the amount of electrical charge in the refresh mode, according to the integrated print density value in each area, and controls the amount of electrical charge applied by the auxiliary charging unit 7, according to the determined distribution pattern (step S16B). Then, the process performs step S18 and subsequent steps.

When such a start condition is employed, the distribution pattern of the amount of electrical charge in the refresh mode may be determined according to the integrated print density value in each area. For example, as illustrated in FIG. 9B, since an area having a relatively high integrated print density value seems to have a relatively small degree of lubricant deterioration, the amount of charge on toner in the corresponding area reaching the image carrier-cleaning member 5 is reduced in increasing degree (small electrical charge), and since an area having a relatively small integrated print density value seems to have a relatively great degree of lubricant deterioration, the amount of charge on toner in the corresponding area reaching the image carrier-cleaning member 5 is increased in increasing degree (large electrical charge). That is, the control unit 50 adjusts the amount of electrical charge applied along the rotational axis direction of the photoreceptor 1 (image carrier) by the auxiliary charging unit 7 (charge unit), according to the integrated print density value of each of the plurality of areas. As described above, an image pattern increasing the amount of electrical charge on an area having a relatively small print density may be formed to selectively scrape lubricant having a great degree of deterioration. When the integrated print density value varies widely in the rotational axis direction of the photoreceptor 1, the amount of electrical charge in an area having a relatively small integrated print density value is increased, and the amount of electrical charge in an area having a relatively high integrated print density value is reduced, and thus the lubricant can be further effectively removed.

Sequential performance of the refresh mode (integrated print density value) is completed, the refresh mode is returned to the normal image forming mode. When the refresh mode is returned to the normal image forming mode, the control unit 50 resets the integrated print density count value to zero (step S34B). When the refresh mode is returned to the normal image forming mode, various conditions are returned to normal values.

(i4: Remarks)

FIG. 10 illustrates the processing procedure according to the refresh mode as a standard, FIG. 11 illustrates the processing procedure to which the refresh mode is added, in addition to the refresh mode as a standard, the fresh mode being performed upon successive printing of the same image pattern, and FIG. 12 illustrates the processing procedure to which the refresh mode is added, in addition to the refresh mode as a standard, the refresh mode being performed upon variation in integrated print density value between areas.

However, the refresh mode as a standard, the refresh mode performed upon successive printing of the same image pattern, and the refresh mode performed upon variation in integrated print density value between areas may be performed singularly or in any combination.

Further, in the refresh mode performed when the same image pattern is successively printed, or when the integrated print density value varies between areas, a procedure similar to the refresh mode as a standard may be performed. That is, processing to be performed may be shared between the refresh modes, and a plurality of start conditions may be prepared for the refresh modes.

J. Effect Confirming Experiment

Results of several experiments for confirming the effects of the above-mentioned lubricant removal and lubricant supply according to the present embodiment (Examples 1 to 9 and Comparative examples 1 to 4) will be shown below.

As a specific experimental procedure, the imaging unit 10 illustrated in FIG. 2 was mounted to an image forming apparatus (modified bizhub PRESS C8000 by KONICA MINOLTA, INC.), combining (1) presence/absence of the auxiliary charging unit 7 (charge unit), and (2) presence/absence of the refresh mode. In each experiment, the amount of charge on toner in the refresh mode was measured, and three items, i.e., (a) blurred image (fuzzy image), (b) blade abrasion, and (c) cleaning failure, were evaluated. Note that in the present experimental system, negatively-charged toner was used. Further, an experimental environment includes a laboratory environment (room temperature 25° C., humidity 35%), and the experiments were performed in the laboratory environment.

The amount of charge on toner in the refresh mode was obtained from the conversion of the transferred charge value and the amount of toner, using the ammeter (product name: KEYTHLEY6514 systemelectorometer) connected to the photoreceptor 1. The transferred charge value was obtained by attracting toner passing the auxiliary charging unit 7.

The blurred image (fuzzy image) was evaluated in fuzzy image rank by visually confirming a printed image. The printed image was obtained after printing an image pattern having a 3% B/W ratio (black/white ratio) on 10,000 sheets and printing a reference image. More specifically, sharpness of an edge portion of the printed reference image was visually confirmed, and evaluation conditions for the blurred image were employed as follows.

without blurred image: ⊙ (good)

with slight blurred image within allowable range: ○ (acceptable)

with slight blurred image: Δ (slightly bad)

noticeable blurred image: x (bad)

The blade abrasion was evaluated in a manner that after the above-mentioned image pattern was printed on 300,000 sheets, the whole edge portion of the image carrier-cleaning member 5 was observed with a microscope (VKX100 by KEYENCE CORPORATION), and an average abrasion width was confirmed. Evaluation criteria for the blade abrasion according to an observed abrasion width were employed as follows.

not more than 40 μm: ○ (good)

40 to 100 μm: Δ (normal)

not less than 100 μm: x (bad)

The cleaning failure was evaluated by visually confirming the quality of the printed image (scumming caused by cleaning failure). The printed image was obtained after printing the above-mentioned image pattern on 10,000 sheets and printing the reference image. Evaluation conditions for the cleaning failure were employed as follows.

without scumming: ○ (good)

with scumming: x (bad)

Examples 1 to 9

In Examples 1 to 9, the experiments were performed using the imaging unit 10 illustrated in FIG. 2. In addition, the refresh mode was performed. The auxiliary charging unit 7 (charge unit) was controlled to have a total current of −50 μA by applying DC bias to the corotron charger. Output from the auxiliary charging unit 7 (charge unit) is different between the refresh mode and the normal image formation. More specifically, during normal image formation, the auxiliary charging unit 7 was controlled to have a total current of −50 μA, and in the refresh mode, the auxiliary charging unit 7 was set to the applied current (charger current) described in each experimental result illustrated below. In the refresh mode, after a halftone dot pattern is formed over the width direction, the photoreceptor 1 is turned around 10 times, and then turned around five times without printing. The transfer condition in the refresh mode was controlled to have a reversed potential difference, compared with the potential difference during normal image formation. The refresh mode was configured to be performed each time of printing 1000 sheets.

Comparative Example 1

In Comparative example 1, the experiment was performed using a configuration in which the auxiliary charging unit 7 (charge unit) was removed from the imaging unit 10 illustrated in FIG. 2. In addition, the refresh mode was not performed. Note that the amount of charge on toner in the refresh mode is replaced with the amount of charge on the remaining toner after transfer.

Comparative Example 2

In Comparative example 1, the experiment was performed using a configuration in which the auxiliary charging unit 7 (charge unit) was removed from the imaging unit 10 illustrated in FIG. 2. The refresh mode was performed. In the refresh mode, after a halftone dot pattern is formed over the width direction, the photoreceptor 1 is turned around 10 times, and then turned around five times without printing. The transfer condition in the refresh mode was controlled to have a reversed potential difference, compared with the potential difference during normal image formation. The refresh mode was configured to be performed each time of printing 1000 sheets.

Comparative Example 3

In Comparative example 3, the experiment was performed using the imaging unit 10 illustrated in FIG. 2. Further, the refresh mode was performed, but output from the auxiliary charging unit 7 (charge unit) is the same between the refresh mode and the normal image formation. The auxiliary charging unit 7 (charge unit) was controlled to have a total current of −50 μA by applying DC bias to the corotron charger. In the refresh mode, after a halftone dot pattern is formed over the width direction, the photoreceptor 1 is turned around 10 times, and then turned around five times without printing. The transfer condition in the refresh mode was controlled to have a reversed potential difference, compared with the potential difference during normal image formation. The refresh mode was configured to be performed each time of printing 1000 sheets.

Comparative Example 4

An experiment condition was similar to those of the Examples 1 to 9 having been described above.

Experimental Result

The experimental results of Examples 1 to 9 and Comparative examples 1 to 4 will be illustrated in the following table.

TABLE 2

| DURING IMAGE FORMATION (NORMAL) ELECTRICAL CHARGE CONTROL | AUXILIARY CHARGING UNIT (CHARGE UNIT) | REFRESH MODE | APPLIED CURRENT | AMOUNT OF CHARGE ON TONER IN REFRESH MODE | QUALITY BLURRED IMAGE | BLADE ABRASION | CLEANING FAILURE |
|---|---|---|---|---|---|---|---|
| EXAMPLE 1 | YES | YES | −75 μA | −23 μC/g | ○ | ○ | ○ |
| EXAMPLE 2 | YES | YES | −100 μA | −26 μC/g | ○ | ○ | ○ |
| EXAMPLE 3 | YES | YES | −120 μA | −30 μC/g | ⊙ | ○ | ○ |
| EXAMPLE 4 | YES | YES | −200 μA | −38 μC/g | ⊙ | ○ | ○ |
| EXAMPLE 5 | YES | YES | −300 μA | −49 μC/g | ⊙ | ○ | ○ |
| EXAMPLE 6 | YES | YES | −400 μA | −60 μC/g | ⊙ | ○ | ○ |
| EXAMPLE 7 | YES | YES | −500 μA | −71 μC/g | ⊙ | ○ | ○ |
| EXAMPLE 8 | YES | YES | −600 μA | −82 μC/g | ⊙ | ○ | ○ |
| EXAMPLE 9 | YES | YES | −650 μA | −87 μC/g | ⊙ | ○ | ○ |
| COMPARATIVE EXAMPLE 1 | NO | NO | — | −12 μC/g | × | × | ○ |
| COMPARATIVE EXAMPLE 2 | NO | YES | — | −14 μC/g | Δ | Δ | ○ |
| COMPARATIVE EXAMPLE 3 | YES | YES | −50 μA | −20 μC/g | Δ | Δ | ○ |
| COMRARATIVE EXAMPLE 4 | YES | YES | −700 μA | −91 μC/g | ⊙ | ○ | × |

*APPLIED CHARGER CURRENT DURING NORMAL IMAGE FORMATION: −50 μA

In Comparative example 1, the refresh mode was not performed and control of the amount of charge on toner was not also performed. Therefore, an image obtained after a 10,000-sheets endurance test showed noticeable blur, and an image obtained after 300,000-sheets endurance test showed abnormal abrasion of the cleaning blade. The results are considered to be caused by the lubricant layer deteriorated cumulatively by repeated printing to have noticeable failure.

In Comparative example 2, the refresh mode was performed, but the amount of charge on toner was not controlled. Therefore, an image obtained in the middle of the endurance test was inhibited from being blurred, but an image obtained after the 10,000-sheets endurance test was considerably blurred, and the blade abrasion had a bad condition.

In Comparative example 3, the auxiliary charging unit 7 (charge unit) was provided, but the amount of charge was not changed between the refresh mode and the normal image formation, and the experimental result was the same as that in Comparative example 2. Considering the results of Comparative examples 2 and 3, the experimental results seem to be caused by the image printing continued while the amount of charge has no difference between the refresh mode and the normal image formation to fully remove deteriorated lubricant.

In contrast to Comparative examples 1 to 3, in Examples 1 to 9, the amount of electrical charge was controlled so that the amount of charge on toner reaching the image carrier-cleaning member 5 was increased relative to the amount of charge on toner supplied during normal image formation, in the refresh mode. As a result, both of the blurred image and the blade abrasion were preferably controlled. This result is considered to be caused by the amount of charge on toner in the refresh mode which is relatively higher than the amount of charge on toner during normal image formation, and by which deteriorated lubricant not scraped during normal image formation can be removed and replaced with a new lubricant layer. In Examples 3 to 9, the quality of the blurred image was further improved. This result is considered to be caused by promotion of the removal of the deteriorated lubricant and the replacement with the new lubricant layer, with the increase of the amount of electrical charge on toner. Considering the results of Examples 3 to 9, the amount of electrical charge on toner is preferably −30 μC/g or more, 1.5 times larger than the amount of charge on toner supplied during normal image formation being −20 μC/g, in absolute value.

In contrast, in Comparative example 4, the printed image showed cleaning failure. The cleaning failure is considered to be caused by a considerably large amount of charge on toner, affecting the image quality. The considerably large amount of charge on toner is considered to cause considerably strong attraction force between toner and the photoreceptor 1 to pass the toner through the cleaning blade without blocking the toner. Therefore, in the refresh mode, the upper limit (absolute value) of the amount of charge on toner reaching the image carrier-cleaning member 5 is further preferably approximately −90 μC/g.

Thus, in the refresh mode, preferably, toner has an amount of charge of not more than 90 μC/g and 1.5 times larger than the amount of charge on toner reaching the image carrier-cleaning member 5 during normal image formation, in absolute value, and the toner is supplied to the image carrier-cleaning member 5.

K. Conclusion

The image forming apparatus 100 according to the present embodiment performs the refresh mode, each time a predetermined start condition (the number of printed sheets, image pattern used for printing, printing history, or the like) is satisfied. In the refresh mode, the amount of charge on toner reaching the image carrier-cleaning member 5 is increased relative to the amount of charge on toner supplied during normal image formation. When such a refresh mode is employed, lubricant on the photoreceptor 1 can be effectively and strongly removed, and blurred image or abnormal abrasion of the blade caused by the deteriorated lubricant remaining on the photoreceptor can be inhibited.

When a local lubricant deterioration seems to occur depending on the image pattern, for example, after the same image pattern is printed on a predetermined number of sheets or a difference in integrated print density value between areas exceeds a predetermined threshold value, the image forming apparatus 100 according to the present embodiment adjusts the image pattern or the distribution pattern of the amount of electrical charge according to the local deterioration, in the refresh mode, and thus, lubricant can be effectively removed while reducing an amount of toner consumed. Therefore, for example, the lubricant layer can be formed again in a preventive manner, against the noticeable deterioration of lubricant in the non-image portion which is caused by successive printing of the same image pattern, and thereby a failure frequency can be reduced.

Although the present invention has been described and illustrated in detail, it is clearly understood that the same is by way of illustrated and example only and is not to be taken by way of limitation, the scope of the present invention being interpreted by terms of the appended claims. The scope of the present invention is intended to include all modifications within the meaning and scope, which are equivalent to the scope of claims.

What is claimed is:

1. An image forming apparatus comprising:

an image carrier;

a development unit configured to develop, as a toner image, an electrostatic latent image formed on the image carrier;

a transfer unit configured to transfer the toner image to a medium to which a toner image is to be transferred;

a cleaning unit configured to recover toner remaining on the image carrier after transferring the toner image;

a lubricant supply unit configured to supply lubricant on the image carrier;

a charge unit disposed between the development unit and the cleaning unit, along a surface of the image carrier; and a control unit, the control unit being configured to perform a first mode and a second mode, the first mode configured to form the toner image for the main purpose of transferring the toner image to the medium to which a toner image is to be transferred, the second mode configured to allow the charge unit to increase the amount of charge on toner reaching the cleaning unit, relative to that in the first mode, for the main purpose of recovering lubricant on the image carrier.

2. The image forming apparatus according to claim 1, wherein the control unit controls the charge unit to have an amount of charge on toner reaching the cleaning unit in the second mode not more than 90 μC/g, and 1.5 times larger than that on toner reaching the cleaning unit in the first mode, in absolute value.

3. The image forming apparatus according to claim 1, wherein the control unit controls the lubricant supply unit to restrict supply of lubricant in the second mode.

4. The image forming apparatus according to claim 1, wherein the control unit controls the transfer condition in the transfer unit to have an amount of toner reaching the cleaning unit in the second mode, being larger than the amount of toner reaching the cleaning unit in the first mode.

5. The image forming apparatus according to claim 1, wherein the development unit functions as the lubricant supply unit.

6. The image forming apparatus according to claim 1, wherein the control unit controls the lubricant supply unit to form a layer of lubricant on the image carrier, following recovery of lubricant on the image carrier, in the second mode.

7. The image forming apparatus according to claim 1, wherein the control unit performs processing according to the second mode, when a predetermined start condition is satisfied.

8. The image forming apparatus according to claim 7, wherein the start condition includes arrival of the number of times of forming the toner image to a predetermined value, in the first mode.

9. The image forming apparatus according to claim 7, wherein the control unit uses an image pattern having toner over a rotational axis direction of the image carrier, in the second mode.

10. The image forming apparatus according to claim 7, wherein the start condition includes continuous formation of the same image pattern a predetermined number of times, in the first mode.

11. The image forming apparatus according to claim 10, wherein the control unit uses a negative pattern obtained by inverting the same image pattern in color, in the second mode.

12. The image forming apparatus according to claim 7, wherein the start condition includes excess of a difference in an integrated print density value over a predetermined value between any two areas, the integrated print density value obtained in the first mode being calculated for each of a plurality of areas set along the rotational axis direction of the image carrier.

13. The image forming apparatus according to claim 12, wherein the control unit adjusts the amount of electrical charge applied by the charge unit, along the rotational axis direction of the image carrier, according to each integrated print density value of the plurality of areas.

14. The image forming apparatus according to claim 1, wherein lubricant is a metal stearate.

15. An image forming method in an image forming apparatus, the image forming apparatus including an image carrier, a development unit configured to develop, as a toner image, an electrostatic latent image formed on the image carrier, a transfer unit configured to transfer the toner image to a medium to which a toner image is to be transferred, a cleaning unit configured to recover toner remaining on the image carrier after transferring the toner image, and a lubricant supply unit configured to supply lubricant on the image carrier, the image forming method comprising:

forming the toner image for the main purpose of transferring the toner image to the medium to which a toner image is to be transferred; and increasing the amount of charge on toner reaching the cleaning unit, relative to that for the main purpose of transferring the toner image to the medium to which a toner image is to be transferred, by a charge unit, for the main purpose of recovering lubricant on the image carrier, the charge unit being disposed along a surface of the image carrier between the development unit and the cleaning unit.

* * * * *